US012624606B2

(12) United States Patent
Werries et al.

(10) Patent No.: US 12,624,606 B2
(45) Date of Patent: May 12, 2026

(54) HIGH FORCE STROKER TOOL

(71) Applicant: NCS MULTISTAGE INC., Calgary (CA)

(72) Inventors: Michael Werries, Calgary (CA); Jonathan Raasch, Calgary (CA); Juan Montero, Calgary (CA); Brock Gillis, Calgary (CA)

(73) Assignee: NCS Multistage Inc., Calgary (CA)

( * ) Notice: Subject to any disclaimer, the term of this patent is extended or adjusted under 35 U.S.C. 154(b) by 207 days.

(21) Appl. No.: 18/566,202

(22) PCT Filed: Sep. 16, 2021

(86) PCT No.: PCT/CA2021/051296

§ 371 (c)(1),
(2) Date: Dec. 1, 2023

(87) PCT Pub. No.: WO2022/251946

PCT Pub. Date: Dec. 8, 2022

(65) Prior Publication Data

US 2024/0295155 A1 Sep. 5, 2024

Related U.S. Application Data

(60) Provisional application No. 63/202,267, filed on Jun. 3, 2021.

(51) Int. Cl.
*E21B 23/04* (2006.01)
*E21B 34/14* (2006.01)

(52) U.S. Cl.
CPC ..... *E21B 23/04* (2013.01); *E21B 34/14* (2013.01)

(58) Field of Classification Search
CPC ..... E21B 23/04; E21B 34/14; E21B 23/01
See application file for complete search history.

(56) References Cited

U.S. PATENT DOCUMENTS 3,896,876 A 7/1975 Crowe
4,125,013 A 11/1978 Nicolas et al.
(Continued)

FOREIGN PATENT DOCUMENTS

CA 3133128 9/2020

OTHER PUBLICATIONS

International Search Report and Written Opinion for International (PCT) Patent Application No. PCT/CA2021/051296, dated Feb. 18, 2022, 7 pages.

(Continued)

*Primary Examiner* — Steven A MacDonald
(74) *Attorney, Agent, or Firm* — Sheridan Ross P.C.

(57) ABSTRACT

A high force stroker tool for integration within a wellbore string disposed along a wellbore defined within a subterranean reservoir is provided. The stroker tool includes a hydraulic anchor hydraulically operable to deploy slips securable to the wellbore and to define a mechanical brace, a shifting tool operatively coupled to the hydraulic anchor and comprising a mechanical anchor securable to a movable component, the shifting tool being mechanically operable to move the movable component; and an actuator coupled between the hydraulic anchor and the shifting tool, the actuator being hydraulically operable to brace against the mechanical brace and create a downhole mechanical force adapted to mechanically operate the shifting tool. A method of shifting downhole valve assemblies using the high force stroker tool is also provided.

20 Claims, 23 Drawing Sheets

(56) References Cited

U.S. PATENT DOCUMENTS 5,636,694 A * 6/1997 Mireles, Jr. ..... E21B 23/042 166/120
7,077,212 B2 7/2006 Roesner et al.
11,927,075 B2 * 3/2024 Montero ..... E21B 41/00
12,025,968 B2 * 7/2024 Laplane ..... G05B 19/195
12,339,638 B2 * 6/2025 Laplane ..... G01B 21/14
2003/0024710 A1 * 2/2003 Post ..... E21B 23/0411 166/66.4
2007/0181298 A1 * 8/2007 Sheiretov ..... E21B 17/1021 166/212
2010/0126710 A1 * 5/2010 Hallundbaek ..... E21B 23/0419 166/66.4
2010/0126725 A1 5/2010 Ravensbergen
2010/0257913 A1 * 10/2010 Storm, Jr. ..... E21B 43/103 72/393
2011/0146970 A1 * 6/2011 Hallundbaek ..... E21B 23/04115 166/212
2012/0000673 A1 * 1/2012 Hogan ..... E21B 7/061 166/85.1
2017/0058644 A1 3/2017 Andreychuk et al.
2017/0356261 A1 * 12/2017 Wai ..... E21B 23/01
2018/0216458 A1 * 8/2018 Garcia ..... E21B 49/10
2019/0017340 A1 * 1/2019 Clemens ..... E21B 23/01
2020/0040679 A1 * 2/2020 Mauchien ..... E21B 17/1021
2020/0332613 A1 * 10/2020 Al Hussin ..... E21B 23/0419
2021/0148179 A1 5/2021 Petrella et al.
2022/0145725 A1 * 5/2022 Montero ..... E21B 23/04
2023/0161316 A1 * 5/2023 Laplane ..... E21B 23/04 166/373
2024/0353810 A1 * 10/2024 Laplane ..... E21B 23/04
2024/0418056 A1 * 12/2024 Andreychuk ..... E21B 23/0411

OTHER PUBLICATIONS

Extended European Search Report for Europe Patent Application No. 21943362.0, dated Apr. 8, 2025, 6 pages.

* cited by examiner

HIGH FORCE STROKER TOOL

CROSS REFERENCE TO RELATED APPLICATIONS

This application is a national stage application under 35 U.S.C. 371 and claims the benefit of PCT Application No. PCT/CA2021/051296 having an international filing date of Sep. 16, 2021 which designated the United States, and which PCT application claimed the benefit of U.S. Provisional Application No. 63/202,267 filed Jun. 3, 2021, the contents of each of which are incorporated herein by reference in their entireties.

TECHNICAL FIELD

The present disclosure relates to technologies for subterranean operations and, more particularly, to bottomhole assemblies, systems and methods that can be used in wellbore sections within subterranean formations, for example to shift sleeves.

BACKGROUND

Downhole operations for shifting components along a wellbore often require specific tools, such as shifting tools, for the application of a force of the component in question. For example, valve assemblies provided with sliding valve sleeves are shifted open using a shifting tool secured thereto, and by pumping fluids down the wellbore. The hydraulic pressure applied on the shifting tool creates the required force for shifting the valve sleeve open. Known shifting tools require a section of the wellbore to be generally sealed, using packers for example, to increase the hydraulic pressure along that section. In such applications, the hydraulic pressure applied to the shifting tool is regulated by the geometry of the shifting tool and the amount of fluid being pumped downhole from the surface.

Hydraulic pressure can be used for shifting valve sleeves installed via interference fit within their valve housing. However, some applications require greater forces which some conventional tools are not configured to generate repeatedly, reliably, or at all. High force applications can be challenging and there is a general need for improvements.

SUMMARY

According to an aspect, a bottomhole assembly for use in actuating a valve assembly disposed along a wellbore defined within a subterranean reservoir is provided. The bottomhole assembly includes an anchoring tool having a tubular housing comprising a top sub, a bottom sub and an outer wall extending between the top and bottom subs, the outer wall being provided with one or more openings. The anchoring tool also has a central mandrel connected between and securing the top and bottom subs to one another, the central mandrel being positioned within the outer wall to define an annular region therebetween. The central mandrel defines a fluid passage therethrough and is adapted to establish fluid communication between the top and bottom subs. The anchoring tool further includes an anchor assembly which has an anchor carrier slidably mounted within the annular region and an anchor pivotally connected to the anchor carrier. The anchor is operable between a disconnected position where the anchor is within the annular region, and a connected position after pivoting outwardly through the outer wall to engage internal surfaces of a casing and secure the anchor assembly relative to the wellbore. The anchoring tool also includes a piston assembly having a piston body slidably mounted within the annular region. The piston body defines a piston chamber in fluid communication with the fluid passage, the piston body being actuatable via fluid pressure to slide uphole within the annular region. The piston assembly includes a piston head coupled to the piston body and adapted to slide in an uphole direction upon actuation of the piston body to engage and operate the anchor from the disconnected position in the connected position. The bottomhole assembly also has an actuator having an inner portion coupled to the anchoring tool and comprising an actuator mandrel and an outer portion slidably mounted to the actuator mandrel and having an actuator piston assembly operable via fluid pressure to displace the outer portion downhole to generate a downhole mechanical force. The bottomhole assembly further includes a shifting tool having a shifting tool mandrel operatively connected to the actuator and a mechanical anchor connected to the shifting tool mandrel and operable to be secured to the valve assembly. The anchoring tool is operable between an unset configuration in which the anchor is in the disconnected position, a pre-set configuration in which the anchor is in the connected position, and a set configuration in which the anchor is in the connected position and the bottom sub abuts the piston body such that the anchor assembly, the piston assembly and the housing define a mechanical brace for transmission of the downhole mechanical force to the valve assembly via the shifting tool.

According to another aspect, a bottomhole assembly for use in actuating a valve assembly disposed along a wellbore defined within a subterranean reservoir is provided. The bottomhole assembly includes an anchoring tool having a tubular housing comprising a top sub, a bottom sub and an outer wall extending between the top and bottom subs, the outer wall being provided with one or more openings. The anchoring tool also has a central mandrel secured between the top and bottom subs and positioned within the outer wall to define an annular region therebetween, the central mandrel defining a fluid passage therethrough and is adapted to establish fluid communication between the top and bottom subs. The anchoring tool includes an anchor assembly having an anchor carrier slidably mounted within the annular region and an anchor pivotally connected to the anchor carrier and operable between a disconnected position where the anchor is at least partially within the annular region, and a connected position after pivoting outwardly through the opening of the outer wall to engage internal surfaces of a wellbore casing and secure the anchor assembly relative to the wellbore. The anchoring tool also includes a piston assembly having a piston body slidably mounted within the annular region, the piston body defining a piston chamber in fluid communication with the fluid passage, the piston body being actuatable via fluid pressure to slide uphole within the annular region. The piston assembly also includes a piston head coupled to the piston body and being adapted to slide in an uphole direction upon actuation of the piston body to engage and operate the anchor from the disconnected position in the connected position. The anchoring tool being operable between an unset configuration in which the anchor is in the disconnected position, a pre-set configuration in which the anchor is in the connected position, and a set configuration in which the anchor is in the connected position and the bottom sub abuts the piston body such that the anchor assembly, the piston assembly and the housing define a mechanical brace for transmission of a downhole mechanical force to the valve assembly.

According to a possible implementation, the anchor assembly includes a plurality of anchors provided about the anchor carrier, and the anchors are adapted to extend through respective openings in the outer wall of the tubular housing.

According to a possible implementation, the anchors are provided at regular intervals about the anchor carrier.

According to a possible implementation, the one or more openings are sized and adapted to enable uphole movement of the housing relative to the anchors when operating the anchoring tool from the pre-set configuration to the set configuration.

According to a possible implementation, each opening includes an opening perimeter, and wherein the anchors are spaced from the opening perimeter during the uphole movement of the housing to prevent contact between the anchors and the outer wall.

According to a possible implementation, the openings include elongate slots extending along the outer wall, and wherein each anchor is aligned with a corresponding one of the elongate slots.

According to a possible implementation, a downhole chamber is defined when the piston assembly is actuated uphole to engage the piston head with the anchor, the downhole chamber being in fluid communication with the fluid passage.

According to a possible implementation, the bottom sub is displaced into the downhole chamber to abut the piston body and define the mechanical brace.

According to a possible implementation, the piston head comprises a setting cone having an outer surface, and the anchor comprises a tapered inner surface spaced from the central mandrel, and wherein the setting cone is adapted to engage the anchor from below the tapered inner surface to urge the anchor outwardly through the opening of the outer wall.

According to a possible implementation, the piston assembly is operable at an anchoring fluid pressure adapted to displace the piston body and piston head in the uphole direction to engage the anchor.

According to a possible implementation, the piston body comprises at least one guiding stud, and wherein the central mandrel comprises at least one guiding channel, the guiding stud being adapted to engage the guiding channel to block rotational movement of the piston assembly about the central mandrel and axially guide the piston assembly along the central mandrel.

According to a possible implementation, the anchor carrier comprises at least one guiding pin, and wherein the central mandrel comprises at least one guiding groove, the guiding pin being adapted to engage the guiding groove to block rotational movement of the anchor assembly about the central mandrel and axially guide the anchor assembly along the central mandrel.

According to a possible implementation, the anchor carrier comprises at least one guiding pin, and wherein the outer wall comprises at least one guiding groove, the guiding pin being adapted to engage the guiding groove to block rotational movement of the anchor assembly about the central mandrel and axially guide the anchor assembly along the annular region.

According to a possible implementation, the bottomhole assembly further includes a shifting tool connectable to the valve assembly, and an actuator operatively coupled between the anchoring tool and the shifting tool, the actuator being adapted to cooperate with the mechanical brace to increase the downhole mechanical force to actuate the shifting tool to shift the valve assembly between various configurations.

According to a possible implementation, the actuator is a linear actuator and comprises an inner portion coupled to the anchoring tool and adapted to cooperate with the mechanical brace, and an outer portion slidably mounted to the inner portion, wherein the actuator is operable to displace the outer portion to apply the downhole mechanical force on the shifting tool.

According to a possible implementation, the inner portion comprises an actuator sub coupled to the anchoring tool, and an actuator mandrel connected to and extending from the actuator sub, and wherein the outer portion comprises an actuator housing slidably mounted to the actuator mandrel and defining an actuator annular region therebetween.

According to a possible implementation, the actuator comprises an actuator piston assembly provided in the actuator annular region and in fluid communication with the fluid passage, the actuator piston assembly being operable via fluid pressure at a shifting fluid pressure to displace the outer portion downhole.

According to a possible implementation, the shifting fluid pressure is between about 6,000 psi and 10,000 psi, and wherein the anchoring fluid pressure is less than the shifting fluid pressure.

According to a possible implementation, the actuator piston assembly is operable at a setting fluid pressure provided between the anchoring fluid pressure and the shifting fluid pressure and being adapted to apply hydraulic pressure on the housing of the anchoring tool to push the bottom sub against the piston body, thereby operating the anchoring tool from the pre-set configuration to the set configuration.

According to a possible implementation, the anchor comprises an anchoring surface provided with one or more grips adapted to engage the casing when operating the anchor in the connected position, wherein engagement of the grips with the internal surface secures the anchor assembly relative to the wellbore.

According to a possible implementation, the bottomhole assembly further includes a flow limiter coupled between and in fluid communication with the anchoring tool and the actuator, the flow limiter being operable between an unrestricted configuration where fluid flowrate remains substantially the same through the flow limiter, and a flow-restricting configuration where fluid flowrate is reduced through the flow limiter.

According to a possible implementation, the flow limiter is hydraulically operable between the unrestricted and the flow-restricting configurations.

According to a possible implementation, the flow limiter comprises a limiter housing and a limiter mandrel extending through the limiter housing, and wherein the limiter housing is slidably mounted to the limiter mandrel.

According to a possible implementation, the limiter housing defines a fluid chamber having inner walls spaced from the limiter mandrel, and wherein the flow limiter further comprises a limiter nozzle positioned along the limiter mandrel within the fluid chamber, the limiter nozzle being provided with a nozzle opening adapted to restrict fluid flow therethrough.

According to a possible implementation, the limiter mandrel comprises fluid channels extending through a thickness of the limiter mandrel for establishing fluid communication between the limiter mandrel and the fluid chamber, and wherein the fluid channels comprise upstream fluid channels provided upstream of the limiter nozzle, and downstream fluid channels provided downstream of the limiter nozzle.

According to a possible implementation, when in the unrestricted configuration, each one of the fluid channels is in fluid communication with the fluid chamber such that fluid flowing through the limiter mandrel is adapted to flow around the limiter nozzle via the fluid channels and fluid chamber.

According to a possible implementation, when in the flow-restricting configuration, the limiter housing is adapted to slide relative to the limiter nozzle to occlude one of the downstream and upstream fluid channels thereby restricting fluid flow through the nozzle opening of the limiter nozzle.

According to a possible implementation, sliding the limiter housing comprises abutting the limiter housing against the limiter nozzle.

According to a possible implementation, sliding the limiter housing comprises positioning the limiter nozzle out of and adjacent to the fluid chamber.

According to a possible implementation, the limiter housing and the limiter nozzle engage one another to define a metal-to-metal seal therebetween.

According to a possible implementation, at least one of the limiter housing and the limiter nozzle is provided with an elastomer sealing component, and wherein the limiter housing and the limiter nozzle engage one another at the elastomer sealing component to define a seal therebetween.

According to a possible implementation, the shifting tool comprises a mechanical anchor configured to engage a valve sleeve of the valve assembly and secure the shifting tool relative to the valve sleeve.

According to a possible implementation, the downhole mechanical force is adapted to break shear fasteners securing a valve sleeve of the valve assembly within the valve assembly and enable movement of the valve sleeve.

According to another aspect, a hydraulic anchor of a stroker tool configured for mechanical connection with a valve assembly disposed along a wellbore defined within a subterranean reservoir is provided. The hydraulic anchor includes a housing comprising a top sub, a bottom sub and an outer wall extending between and securing the top and bottom subs to one another, a central mandrel secured between the top and bottom subs and positioned within the outer wall, the central mandrel defining a fluid passage therethrough and is adapted to establish fluid communication between the top and bottom subs. The hydraulic anchor has an anchor assembly provided proximate the top sub and includes an anchor carrier slidably mounted to the central mandrel and an anchor pivotally connected to the anchor carrier and being operable between a disconnected configuration where the anchor is at least partially within the annular region, and a connected position after pivoting outwardly through the elongate opening of the outer wall to engage internal surfaces of the casing and secure the anchor assembly relative to the wellbore. The hydraulic anchor also includes a piston assembly provided between the anchor assembly and the bottom sub, comprising a piston body slidably coupled to the central mandrel, the piston body having a piston chamber in fluid communication with the fluid passage, the piston body being actuatable via fluid flow to slide along the tubular mandrel. The piston assembly has a piston head coupled to the piston body and being slidably mounted to the central mandrel, the piston head being adapted to slide along the central mandrel in an uphole direction upon actuation of the piston body to engage and operate the anchor in the connected configuration. The hydraulic anchor being operable between an unset configuration in which the anchor is in the disconnected position, a pre-set configuration in which the anchor is in the connected position, and a set configuration in which the anchor is in the connected position and the bottom sub abuts the piston body such that the anchor assembly, the piston assembly and the housing define a mechanical brace for transmission of a downhole mechanical force to the valve assembly.

According to another aspect, a method of shifting a valve sleeve of a valve assembly provided along a wellbore string disposed within a wellbore defined within a subterranean reservoir using a stroker tool is provided. The method includes the steps of injecting fluid down the wellbore string to increase a fluid pressure within a hydraulic anchor of the stroker tool to an anchoring pressure adapted to have a piston assembly of the hydraulic anchor engage and secure an anchor assembly of the hydraulic anchor to the casing; increasing the fluid pressure to a setting pressure adapted to engage a housing of the hydraulic anchor with the piston assembly to set the hydraulic anchor, with the housing, the piston assembly and the anchor assembly defining a mechanical brace with the wellbore; and increasing the fluid pressure to a shifting pressure adapted to operate an actuator of the bottomhole assembly. The actuator being adapted to brace on the mechanical brace for creating a downhole mechanical force for actuating a shifting tool connected to the valve sleeve.

According to a possible implementation, the valve sleeve is secured along the wellbore via shear connectors, and wherein the downhole mechanical force is adapted to break the shear connectors.

According to another aspect, a stroker tool for deployment within a wellbore defined within a subterranean reservoir and provided with a valve assembly is provided. The stroker tool includes an anchoring tool having a tubular housing comprising a top sub, a bottom sub and an outer wall extending between and securing the top and bottom subs to one another, a central mandrel secured between the top and bottom subs and positioned within the outer wall to define an annular region therebetween. The anchoring tool further includes an anchor assembly slidably mounted within the annular region and operable between a retracted position where the anchor assembly is within the annular region, and an extended position where the anchor assembly is secured to a casing of the wellbore. The anchoring tool further includes a piston assembly slidably mounted within the annular region and operable via fluid pressure to slide uphole within the annular region to engage and operate the anchor assembly from the retracted position to the extended position. The stroker tool also has an actuator comprising an inner portion coupled to the anchoring tool and comprising an actuator mandrel; and an outer portion slidably mounted to the actuator mandrel and comprising an actuator piston assembly operable via fluid pressure to displace the outer portion downhole to generate a downhole mechanical force. The stroker tool also includes a shifting tool comprising a shifting tool mandrel operatively connected to the actuator and a mechanical anchor connected to the shifting tool mandrel and operable to be secured to the valve assembly. The shifting tool being actuatable via operation of the actuator to transmit the downhole mechanical force to the valve assembly for moving the valve assembly in an open configuration. The stroker tool includes a flow limiter comprising a limiter housing coupled between the anchoring tool and the actuator; and a limiter mandrel extending through the limiter housing, where the limiter housing is slidably mounted to the limiter mandrel. The flow limiter being operable between an unrestricted configuration where fluid flowrate remains substantially the same through the flow limiter, and a flow-restricting configuration where fluid flowrate is reduced through the flow limiter and into the actuator.

According to a possible implementation, the flow limiter is hydraulically operable between the unrestricted and the flow-restricting configurations.

According to a possible implementation, the limiter housing defines a fluid chamber having inner walls spaced from the limiter mandrel, and wherein the flow limiter further comprises a limiter nozzle positioned along the limiter mandrel within the fluid chamber, the limiter nozzle being provided with a nozzle opening adapted to restrict fluid flow therethrough.

According to a possible implementation, the limiter mandrel comprises fluid channels extending through a thickness of the limiter mandrel for establishing fluid communication between the limiter mandrel and the fluid chamber, and wherein the fluid channels comprise upstream fluid channels provided upstream of the limiter nozzle, and downstream fluid channels provided downstream of the limiter nozzle.

According to a possible implementation, when in the unrestricted configuration, each one of the fluid channels is in fluid communication with the fluid chamber such that fluid flowing through the limiter mandrel is adapted to flow around the limiter nozzle via the fluid channels and fluid chamber.

According to a possible implementation, when in the flow-restricting configuration, the limiter housing is adapted to slide uphole to occlude the downstream fluid channels thereby restricting fluid flow through the nozzle opening of the limiter nozzle.

According to a possible implementation, sliding the limiter housing uphole comprises abutting the limiter housing against the limiter nozzle.

According to another aspect, a high force stroker tool for integration within a wellbore string disposed along a wellbore defined within a subterranean reservoir is provided. The high force stroker tool includes a hydraulic anchor hydraulically operable to deploy slips securable to the wellbore and to define a mechanical brace, and a shifting tool operatively coupled to the hydraulic anchor and comprising a mechanical anchor securable to a movable component, the shifting tool being mechanically operable to move the movable component; and an actuator coupled between the hydraulic anchor and the shifting tool, the actuator being hydraulically operable to brace against the mechanical brace and create a downhole mechanical force adapted to mechanically operate the shifting tool.

According to a possible implementation, the high force stroker tool of claim further comprises a pressure switch operable to restrict a flowrate of fluid into the actuator.

According to another aspect, a bottomhole assembly for deployment within a wellbore defined within a subterranean reservoir and provided with a valve assembly is provided. The bottomhole assembly includes an anchoring tool having a tubular housing comprising an uphole end, a downhole end and an outer wall provided with one or more openings, a central mandrel secured between the uphole end and the downhole end, and positioned within the outer wall to define an annular region therebetween, the central mandrel defining a fluid passage therethrough. The anchoring tool includes an anchor assembly having an anchor carrier slidably mounted within the annular region; and an anchor pivotally connected to the anchor carrier and being operable between a disconnected position where the anchor is at least partially within the annular region, and a connected position after pivoting outwardly through the opening of the outer wall to engage one of a casing of the wellbore and the valve assembly, and secure the anchor assembly relative to the wellbore. The anchoring tool has a piston assembly provided with a piston body slidably mounted within the annular region, the piston body defining a piston chamber in fluid communication with the fluid passage, the piston body being actuatable via fluid pressure to slide toward the anchor assembly within the annular region, and further includes a piston head coupled to the piston body and being adapted to slide toward the anchor assembly upon actuation of the piston body to engage and operate the anchor from the disconnected position in the connected position. The anchoring tool being operable between an unset configuration in which the anchor is in the disconnected position, a pre-set configuration in which the anchor is in the connected position, and a set configuration in which the anchor is in the connected position and the bottom sub abuts the piston body such that the anchor assembly, the piston assembly and the housing define a mechanical brace for transmission of a mechanical force to the valve assembly.

According to a possible implementation, the valve assembly comprises a movable valve sleeve shiftable between a closed position and an open position, and wherein the mechanical force is transmitted to the valve assembly to move the valve sleeve from the closed position to the open position.

According to a possible implementation, the valve assembly comprises a movable valve sleeve shiftable between a closed position and an open position, and wherein the mechanical force is transmitted to the valve assembly to move the valve sleeve from the open position to the closed position.

According to a possible implementation, the anchoring tool is adapted to be positioned within the valve assembly where the anchor assembly is operable to have the anchor be secured to the valve sleeve when in the connected position.

According to a possible implementation, the piston body and the piston head slide in an uphole direction toward the anchor assembly.

According to another aspect, a bottomhole assembly for deployment within a wellbore defined within a subterranean reservoir and provided with a casing lining an interior surface of the wellbore and at least one downhole component is provided. The bottomhole assembly includes an anchoring tool having a tubular housing comprising a top sub, a bottom sub and an outer wall extending between the top and bottom subs, the outer wall being provided with one or more openings; a central mandrel connected between and securing the top and bottom subs to one another, the central mandrel being positioned within the outer wall to define an annular region therebetween, the central mandrel defining a fluid passage therethrough and is adapted to establish fluid communication between the top and bottom subs. The anchoring tool also includes an anchor assembly having an anchor carrier slidably mounted within the annular region; and an anchor pivotally connected to the anchor carrier and being operable between a disconnected position where the anchor is within the annular region, and a connected position after pivoting outwardly through the elongate opening of the outer wall to engage one of the casing and the downhole component, and secure the anchor assembly relative to the wellbore. The anchoring tool also includes a piston assembly having a piston body slidably mounted within the annular region, the piston body defining a piston chamber in fluid communication with the fluid passage, the piston body being actuatable via fluid pressure to slide within the annular region and toward the anchor assembly, and a piston head coupled to the piston body and being adapted to slide within the annular region and toward the anchor assembly upon actuation of the piston body to engage and operate the anchor from the disconnected position in the connected position. The bottomhole assembly has an actuator operatively coupled to the anchoring tool and including an inner portion comprising an actuator mandrel; and an outer portion slidably mounted to the actuator mandrel and comprising an actuator piston assembly operable via fluid pressure to displace the outer portion along the actuator mandrel to generate a mechanical force. The bottomhole assembly also includes a shifting tool including a shifting tool mandrel operatively connected to the actuator; and a mechanical anchor connected to the shifting tool mandrel and operable to be secured to one of the casing and the downhole component. The anchoring tool being operable between an unset configuration in which the anchor is in the disconnected position, a pre-set configuration in which the anchor is in the connected position, and a set configuration in which the anchor is in the connected position and the bottom sub abuts the piston body such that the anchor assembly, the piston assembly and the housing define a mechanical brace for transmission of the mechanical force to the downhole component.

According to a possible implementation, the inner portion is connected to the anchoring tool, and wherein the outer portion is connected to the shifting tool.

According to a possible implementation, the anchoring tool is positioned uphole of the actuator, and wherein the shifting tool is positioned downhole of the actuator.

According to a possible implementation, the downhole component comprises a valve assembly provided with a movable valve sleeve, and wherein the mechanical force is transmitted to the valve assembly to move the valve sleeve.

According to a possible implementation, the shifting tool is adapted to be positioned within the valve assembly such that the mechanical anchor is operable to be secured to the valve sleeve.

According to a possible implementation, the mechanical force is transmitted to the valve assembly via the mechanical anchor, and wherein the shifting tool is adapted to urge the valve sleeve in a downhole direction to move the valve sleeve from a closed position into an open position.

According to a possible implementation, the anchoring tool is adapted to be positioned within the valve assembly such that the anchor assembly is operable to have the anchor be secured to the valve sleeve when in the connected position.

According to a possible implementation, the mechanical force is transmitted to the valve assembly via the anchor of the anchor assembly, and wherein the anchoring tool is adapted to urge the valve sleeve in an uphole direction to move the valve sleeve from an open position into a closed position.

DETAILED DESCRIPTION

Figure 1:
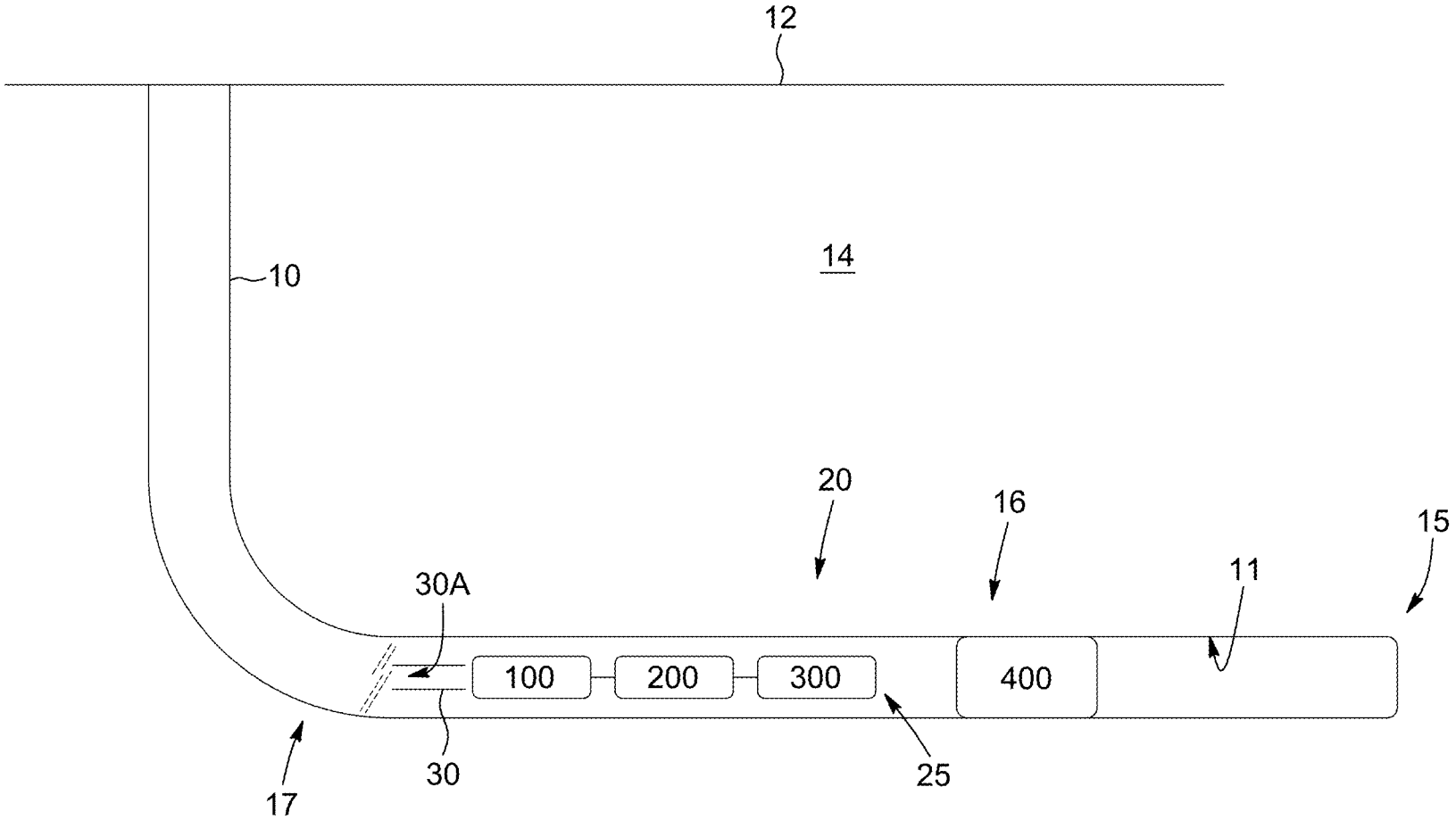
FIG. 1 is a transverse cut view of a wellbore extending in a reservoir with a bottomhole assembly provided along the wellbore, according to an implementation.
Figure 2:
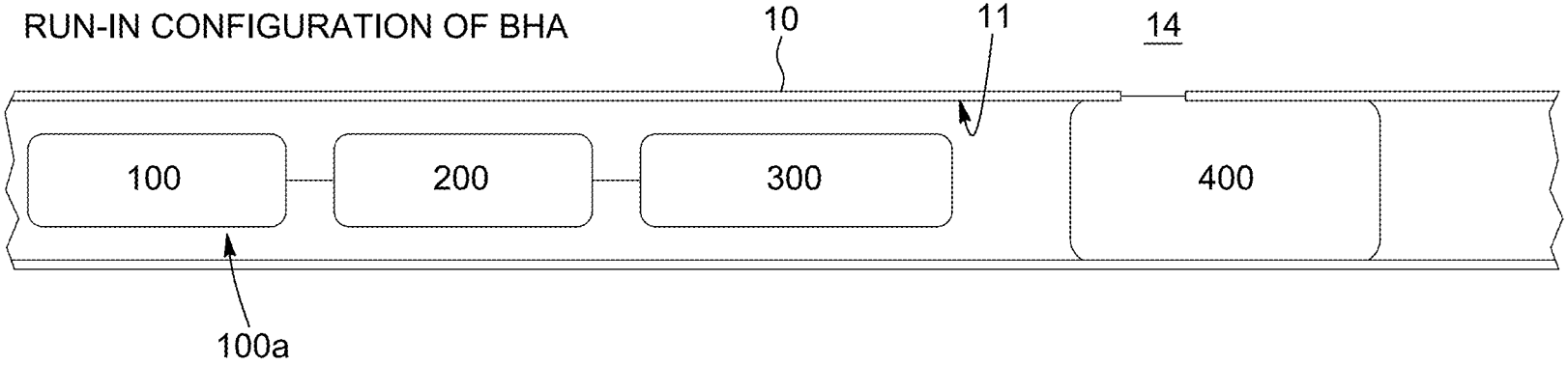
FIG. 2 is an enlarged view of a horizontal section of the wellbore shown in FIG. 1, showing a hydraulic anchor of the bottomhole assembly in a run-in configuration, according to an implementation.

As will be explained below in relation to various implementations, the present disclosure describes apparatuses, systems and methods for various operations, such as the operation of equipment disposed downhole in a wellbore.

In some implementations, the present disclosure describes a bottomhole assembly for integration within a wellbore string disposed along a wellbore extending into the subterranean reservoir. The bottomhole assembly can be deployed downhole in a run-in configuration, and is converted to an operational configuration that uses hydraulic pressure to generate a mechanical force in order to effect a downhole operation. For example, when the downhole operation involves opening or closing a downhole valve assembly by shifting a slidable valve sleeve, the bottomhole assembly can include a stroker tool, which includes a shifting tool for interacting with the valve sleeve, an actuator operatively coupled to the shifting tool to provide the mechanical force to operate the shifting tool, and a hydraulic anchor connected to the actuator and securable to the wellbore to maintain the position of the bottomhole assembly during the sleeve shifting operation. The hydraulic anchor and the actuator are hydraulically operable and cooperate with one another to create a mechanical force adapted to actuate the shifting tool and shift the valve sleeve, for example, to establish fluid communication between the wellbore string and the reservoir. In some implementations, the hydraulic anchor and actuator are operable at high fluid pressures which is converted, via operation of the actuator, in a high mechanical force, for shifting downhole components.

It should be noted that, throughout the present disclosure, the expression "mechanical force" generally corresponds to a high force (e.g., high mechanical force) generated by the actuator of the bottomhole assembly. Common shifting tools are hydraulically operated, with the applied load being controlled by the injection rate of fluid from the surface. In these implementations, the shifting tool is operable via fluid pressure to generate a shifting force between about 4000 psi and 8000 psi, which can be sufficient to shift components secured downhole via interference fit, for example. In other words, known shifting tools can be hydraulically operated to generate the shifting force. In the present disclosure, the bottomhole assembly includes a high force stroker tool configured to use hydraulic pressure (e.g., between about 1000 psi and about 15,000 psi) to operate the actuator, which generates a high mechanical force between about 50,000 lbf and about 150,000 lbf to actuate the shifting tool. These high forces can be used to shift components secured downhole via shear connectors, for example, or components which have become stuck along the wellbore.

As will be described further below, the hydraulic anchor can be operated in various configurations, including an unset configuration where the components of the hydraulic anchor are spaced from the wellbore, thereby enabling downhole deployment of the stroker tool. Once downhole, the hydraulic anchor can be operated in a pre-set configuration where an anchor assembly of the hydraulic anchor engages the wellbore, thereby securing a portion of the hydraulic anchor relative to the wellbore. It should be noted that the wellbore includes a casing lining the inner surface of the wellbore, and that the expression "engaging the wellbore" refers to engagement with the casing or other tubular lining in the wellbore. The casing can be adapted to contribute to the stabilization of the reservoir after the wellbore has been drilled, e.g., by contributing to the prevention of the collapse of the walls of the wellbore. Then, the hydraulic anchor can be operated in a set configuration, where the housing of the hydraulic anchor abuts against the secured portion and defines therewith a mechanical brace for other components of the stroker tool to brace against. As will be described below, a first portion of the actuator is adapted to brace against the mechanical brace, and a second portion of the actuator is hydraulically operable to longitudinally extend along the wellbore. The actuator is thus operable to expand between the hydraulic anchor and the shifting tool, with the mechanical brace preventing uphole expansion of the actuator, thereby restricting the expansion (e.g., extending) downhole. The second portion is coupled to the shifting tool such that the expansion of the actuator creates a driving force, i.e., the high mechanical force, for urging the shifting tool downhole, which transfers the mechanical force to the valve sleeve, thus shifting the valve sleeve in an open position, for example.

It should be understood that, as used herein, the expression "mechanical brace" can refer to an assembly of components functionally fitted together and engaging another structure to provide support. More particularly, the mechanical brace of the present disclosure relates to components of the hydraulic anchor coming into to contact with one another and with the casing of the wellbore to define the support for other components of the stroker tool to brace up against. The mechanical brace can be defined via solid contact (e.g., metal-to-metal) between the various components of the hydraulic anchor. The mechanical brace can also be defined via a combination of solid material and non-compressible fluid, such as a hydraulically pressurized chamber provided between a pair of solid components of the hydraulic anchor, for example. In other words, the mechanical brace can be a load-bearing assembly of components that contact each other and are adapted to define a load-bearing path, notably in the axial direction, between the wellbore (e.g., the casing) and the actuator of the stroker tool.

In some implementations, fluid is injected down the wellbore at a generally constant flowrate which can increase the hydraulic pressure along the stroker tool to operate the actuator. The actuator then generates the mechanical force required to actuate the shifting tool. As will be described further below, the continuous influx of pressurized fluid into the actuator can generate a generally constant pushing force, resulting in a continuously accelerating actuator until an impact occurs along the wellbore. In some implementations, the acceleration of the actuator occurs once the valve sleeve of the valve assembly is shifted in the open position (e.g., once the shear connectors securing the valve sleeve have failed/been broken). As such, the actuator can expand further and faster along the wellbore upon release, which can result in high impact loading.

In other words, the valve sleeve and/or shifting tool can be shifted to the open position and can be moved further downhole until it impacts a shoulder of the valve assembly configured to limit downhole movement of the valve sleeve. The sudden stop of the valve sleeve, in combination with the kinetic energy generated by the operation of the actuator, causes the impact loading on the bottomhole assembly. It is noted that impact loading can cause damage to various parts of the stroker tool. Therefore, in some implementations, the stroker tool can be provided with a flow limiter coupled between the hydraulic anchor and the actuator. The flow limiter is operable to restrict the flowrate of fluid into the actuator, which reduces the expansion rate of the actuator, which in turn reduces the rate at which the valve sleeve open, and thereby prevents excessive impact loading.

In example implementations, the valve sleeve is detachably secured to a valve housing of the valve assembly in a first position, such as via shear fasteners, such that a sufficient mechanical force is required to break, shear, or otherwise disconnect the valve sleeve from the valve housing. With the shear fasteners broken, the valve sleeve can be shifted—for example, shifted into the open position to establish fluid communication with the reservoir. In some implementations, the valve assembly is operable to inject fluid (e.g., a fluid for stimulating hydrocarbon production via a drive process, such as waterflooding, or via a cyclic process, such as "huff and puff") into the reservoir, produce reservoir fluids, or a combination of both. As will be further described, the valve sleeve can also be shifted into the closed position (e.g., from the open position) to at least partially block fluid communication with the reservoir.

As will be described further below, the hydraulic anchor can define the upholemost component of the bottomhole assembly, and can thus include a housing adapted to be coupled to a conduit of the wellbore string. The hydraulic anchor can also include a mandrel connected to the housing and defining a fluid passage to enable fluid flow through the hydraulic anchor. The hydraulic anchor further includes a piston assembly hydraulically operable to slide within the housing and engage the anchor assembly for securing the anchor assembly to the casing of the wellbore. It is thus noted that the anchor assembly and the piston assembly are both independently slidably mounted within the housing. As such, the anchor assembly and the piston assembly are adapted to move relative to one another and the housing. Similarly, the housing can be adapted to move along the wellbore independently from the anchor assembly and/or the piston assembly. The housing is designed to be displaced in at least one of the uphole and downhole directions while the anchor assembly is secured to casing of the wellbore, and abut against the piston assembly. It is appreciated that the housing abuts the piston assembly, which is engaged with the anchor assembly, which is in turn secured to casing of the wellbore. In other words, the components of the hydraulic anchor are configurable to cooperate and define the mechanical brace with the wellbore (i.e., with the casing).

It is noted that the various implementations of the bottomhole assembly and corresponding components described herein can be implemented in various wellbores, formations, and for various applications such as shearing valve sleeves from within their respective valve housings. In some implementations, the wellbore can be straight, curved, or branched, and can have various wellbore sections. A wellbore section should be considered to be an axial length of a wellbore. A wellbore section can be characterized as "vertical" or "horizontal" even though the actual axial orientation can vary from true vertical or true horizontal, or can tend to undulate or corkscrew or otherwise vary. The term "horizontal", when used to describe a wellbore section, refers to a horizontal or highly deviated wellbore section as understood in the art, such as a wellbore section having a longitudinal axis that is between 70 and 110 degrees from vertical. For simplicity, it is noted that the conduits, channels, passageways, pipes, tubes and/or other similar components referred to in the present disclosure have a cross-section that is preferably circular or annular, although it should be appreciated that other shapes are also possible.

With reference to FIG. 1, a wellbore 10 extends from the surface 12 and into a reservoir 14. In this implementation, the wellbore 10 can include a casing 11 lining the inner surface of the wellbore. A bottomhole assembly 20 including one or more components can be integrated as part of a tubing string 30 extending within the wellbore 10. The tubing string 30 defines a tubing string passage 30A for conducting fluid from the surface 12 and down the wellbore 10. In some implementations, the bottomhole assembly 20 includes at least one passage allowing fluid flow therethrough. It should therefore be understood that the bottomhole assembly 20 forms part of the tubing string passage 30A along at least a portion of the wellbore, such that fluids pumped into the tubing string passage 30A flows into the bottomhole assembly 20.

Figure 3:
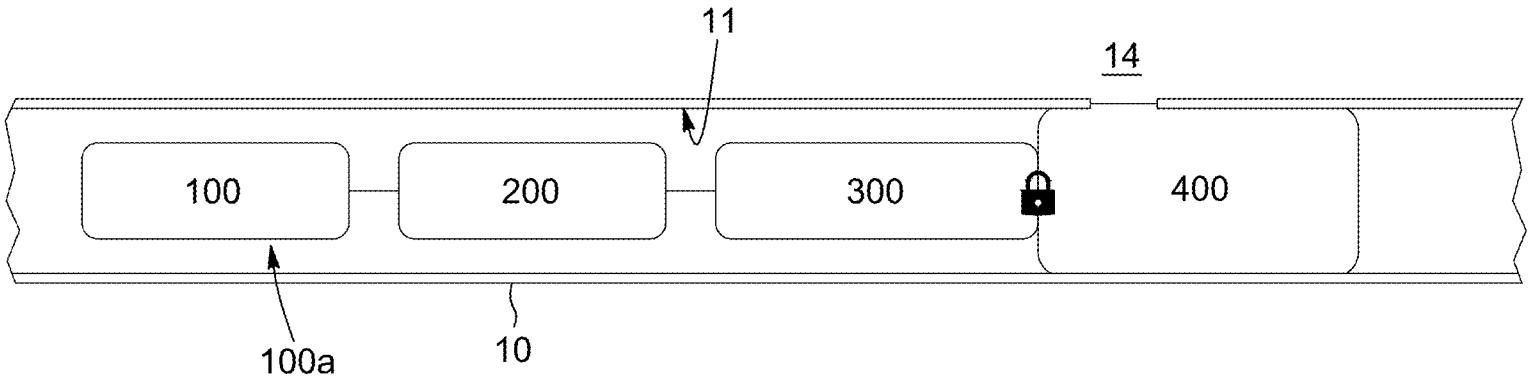
FIG. 3 is an enlarged view of the horizontal section of the wellbore shown in FIG. 1, showing the bottomhole assembly in engagement with a valve assembly, according to an implementation.
Figure 4:
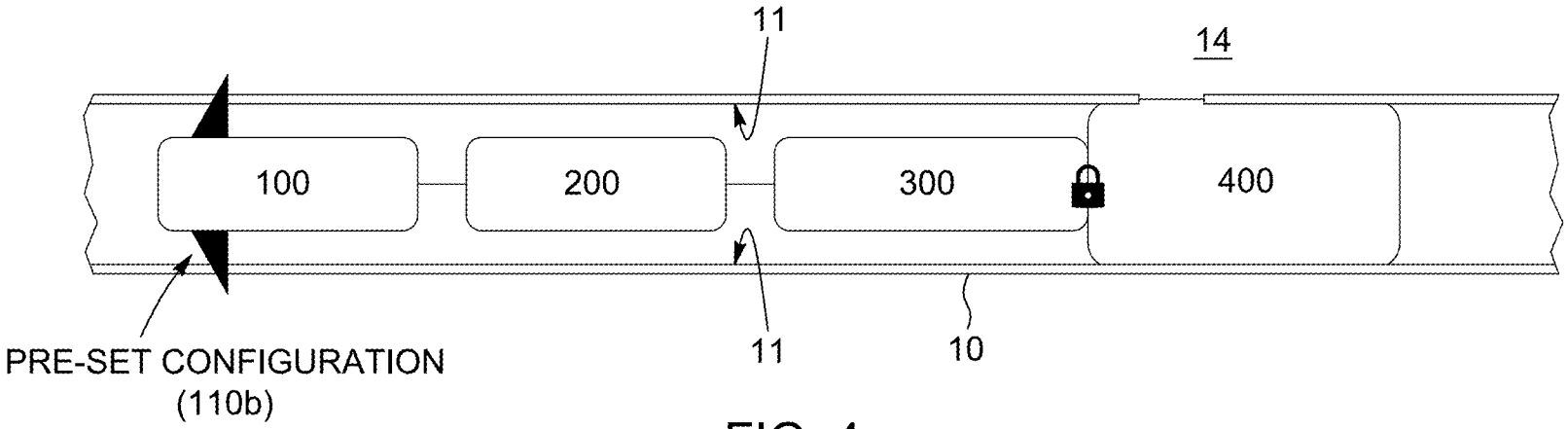
FIG. 4 is an enlarged view of the horizontal section of the wellbore shown in FIG. 1, showing the hydraulic anchor of the bottomhole assembly in a pre-set configuration, according to an implementation.
Figure 5:
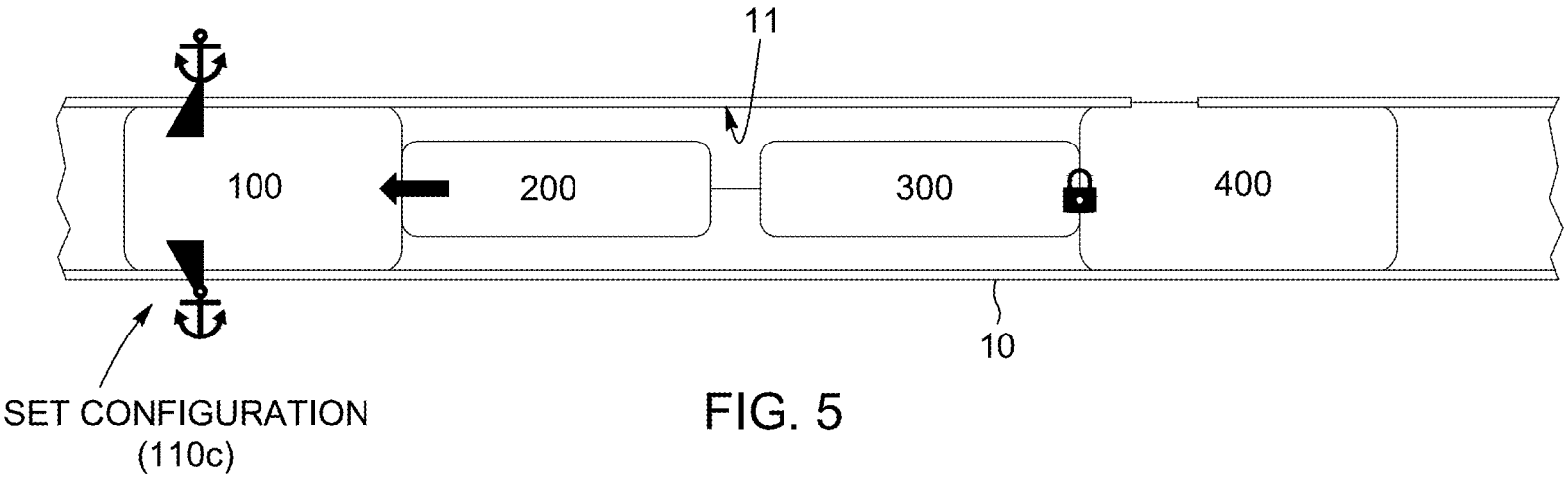
FIG. 5 is an enlarged view of the horizontal section of the wellbore shown in FIG. 1, showing the hydraulic anchor of the bottomhole assembly in a set configuration, according to an implementation.
Figure 6:
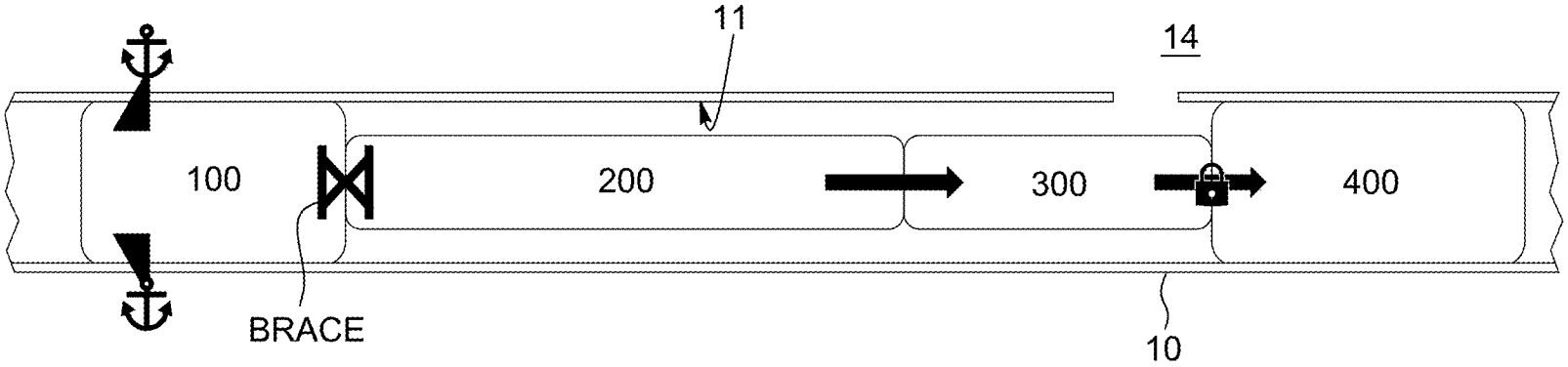
FIG. 6 is an enlarged view of the horizontal section of the wellbore shown in FIG. 1, showing the bottomhole assembly in operation to define a brace and shift the valve assembly, according to an implementation.

With reference to FIGS. 2 to 6, in addition to FIG. 1, the bottomhole assembly 20 includes a stroker tool 25 provided with an anchoring tool 100, an actuator 200 and a shifting tool 300 operatively connected to one another. As illustrated, the actuator 200 is adapted to be coupled between the anchoring tool 100 and the shifting tool 300. As will be described in more detail below, the stroker tool 25 is adapted to be deployed downhole, i.e., as part of the tubing string 30, toward a movable or shiftable downhole feature, such as a valve assembly 400 (FIGS. 1 and 2) previously installed in the wellbore. Once proximate the valve assembly 400, the shifting tool 300 is operated to connect to the valve assembly 400 (FIG. 3). The anchoring tool 100 can then be operated in a pre-set configuration, where the anchoring tool 100 engages the casing of the wellbore 10 to secure a portion of the anchoring tool 100 relative to the wellbore (FIG. 4). Operation of the actuator 200 is then initiated and includes expansion of the actuator between the anchoring tool 100 and the shifting tool 300. The actuator is thus adapted to apply a load on the anchoring tool which shifts the anchoring tool 100 in a set configuration where uphole movement of the anchoring tool 100 is blocked (FIG. 5). The actuator 200 continues to expand and braces up against the anchoring tool 100 (which prevents uphole movement), thereby restricting its expansion to a downhole direction and generating the mechanical force adapted to actuate the shifting tool 300. The shifting tool 300 transmits the mechanical force to the valve assembly 400 due to its connection therewith and shifts the valve assembly 400 in an open configuration to establish fluid communication between the wellbore 10 and the reservoir 14 (FIG. 6).

In some implementations, each valve assembly 400 can include a valve sleeve slidably mounted within a valve housing for obstructing a valve port in communication with the surrounding reservoir. The valve sleeve is movable (e.g., slidable) into an open position via actuation of the shifting tool 300. In other words, fluid communication between the surface 12 and the reservoir 14 can be established by opening the valve assemblies 400 provided along the wellbore via operation of the stroker tool 25.

As seen in FIG. 1, the wellbore 10 can include a horizontal wellbore section 16 having a toe 15 and a heel 17 at respective ends thereof. It should be understood that, as used herein, the expression "toe" refers to an end region of the horizontal wellbore section, such as the end region furthest from surface. Similarly, the expression "heel", as used herein, refers to the opposite end region of the horizontal section, i.e., the beginning of the horizontal wellbore section 16, and may include at least part of the curved transition section between the horizontal and vertical sections of the wellbore 10. Therefore, the expressions "downhole" and "uphole" used herein can refer to directional features, whereby uphole is in a general direction towards the heel 17, and downhole is in a general direction towards the toe 15.

Now referring to FIGS. 7 to 13, the anchoring tool 100 includes a tubular housing 102 adapted to be coupled to the tubular string along the wellbore. In some implementations, the tubular housing 102 includes a top sub 104 provided at an uphole end 105 of the anchoring tool 100, and a bottom sub 106 provided at a downhole end 107 of the anchoring tool 100. The tubular housing 102 also includes an outer wall 108 extending and coupled between the top and bottom subs. It is noted that the top sub 104 is adapted to be coupled to and be in fluid communication with a conduit of the tubing string 30 (e.g., see FIG. 1), and the bottom sub 106 is adapted to be coupled and in fluid communication with the actuator 200. In this implementation, the anchoring tool 100 also includes a central mandrel 110 secured (e.g., threaded) between the top and bottom subs 104, 106, thereby securing the top and bottom subs to one another. It is appreciated that, in some implementations, the top and bottom subs can be alternatively, or additionally, secured to one another via the outer wall 108. Other alternative implementations are possible, ~~such as having an anchoring tool 100 without a top sub, where the central mandrel is adapted to connect with conduits of the tubing string, for example.~~

The central mandrel 110 defines a mandrel passage 112 therethrough for allowing fluid to flow, and is adapted to establish fluid communication between the top and bottom subs. In other words, fluid can be pumped down the tubing string and into the anchoring tool 100 via the top sub 104, flow through the anchoring tool 100 via the central mandrel 110 and exit the anchoring tool 100 via the bottom sub 106.

Figure 9:
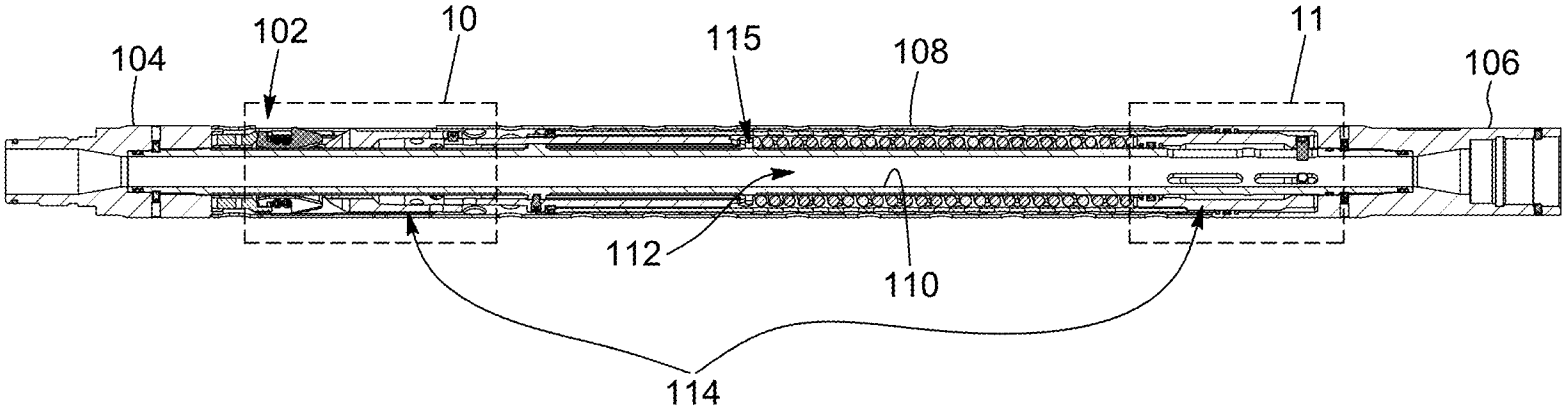
FIG. 9 is a cross-sectional view of the hydraulic anchor shown in FIG. 8, showing a piston assembly operatively coupled to the anchor assembly, according to an implementation.
Figure 10:
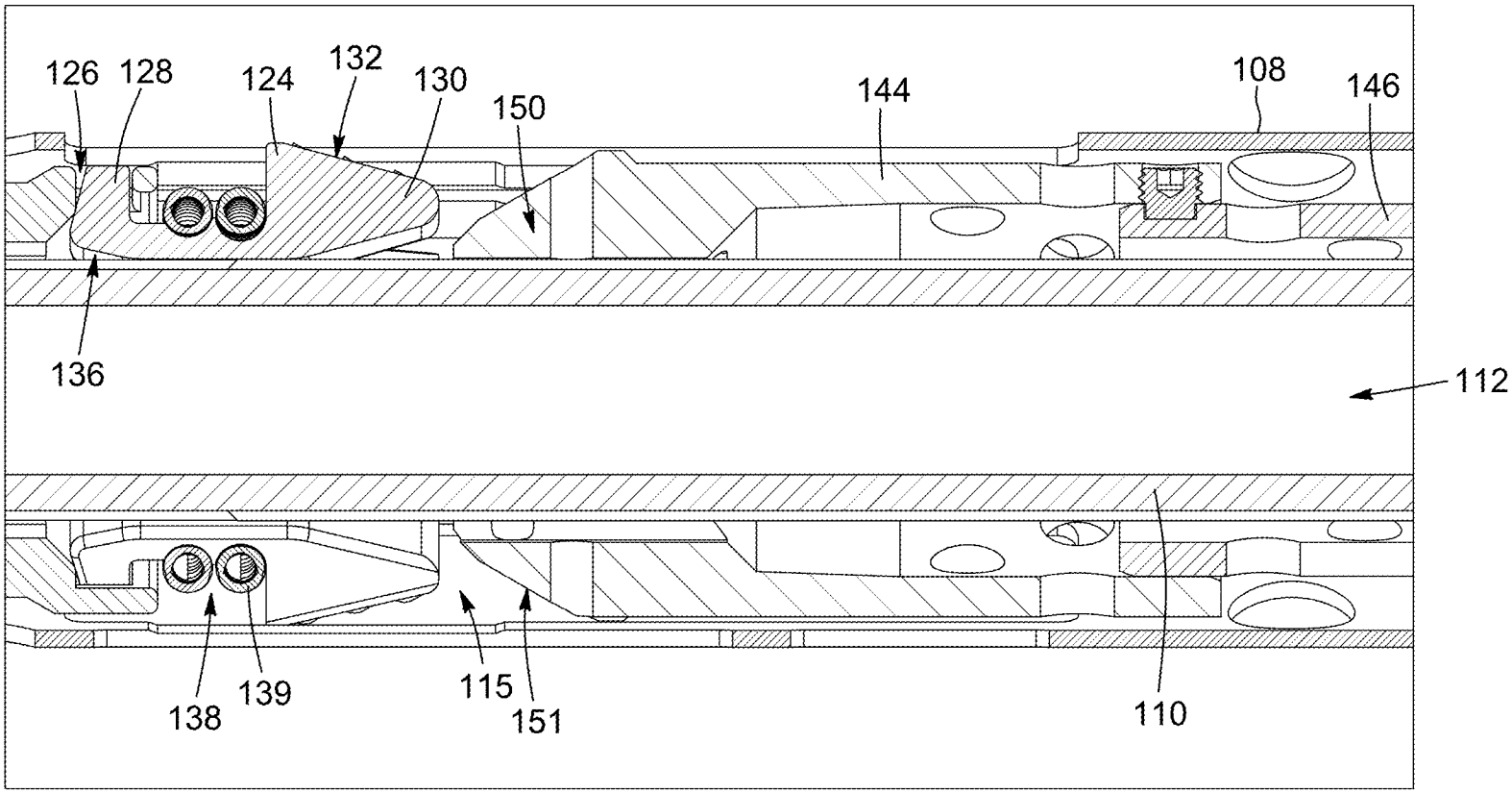
FIG. 10 is an enlarged view of the identified section of FIG. 9, showing a setting cone of the piston assembly adapted to engage the anchors of the anchor assembly, according to an implementation.
Figure 11:
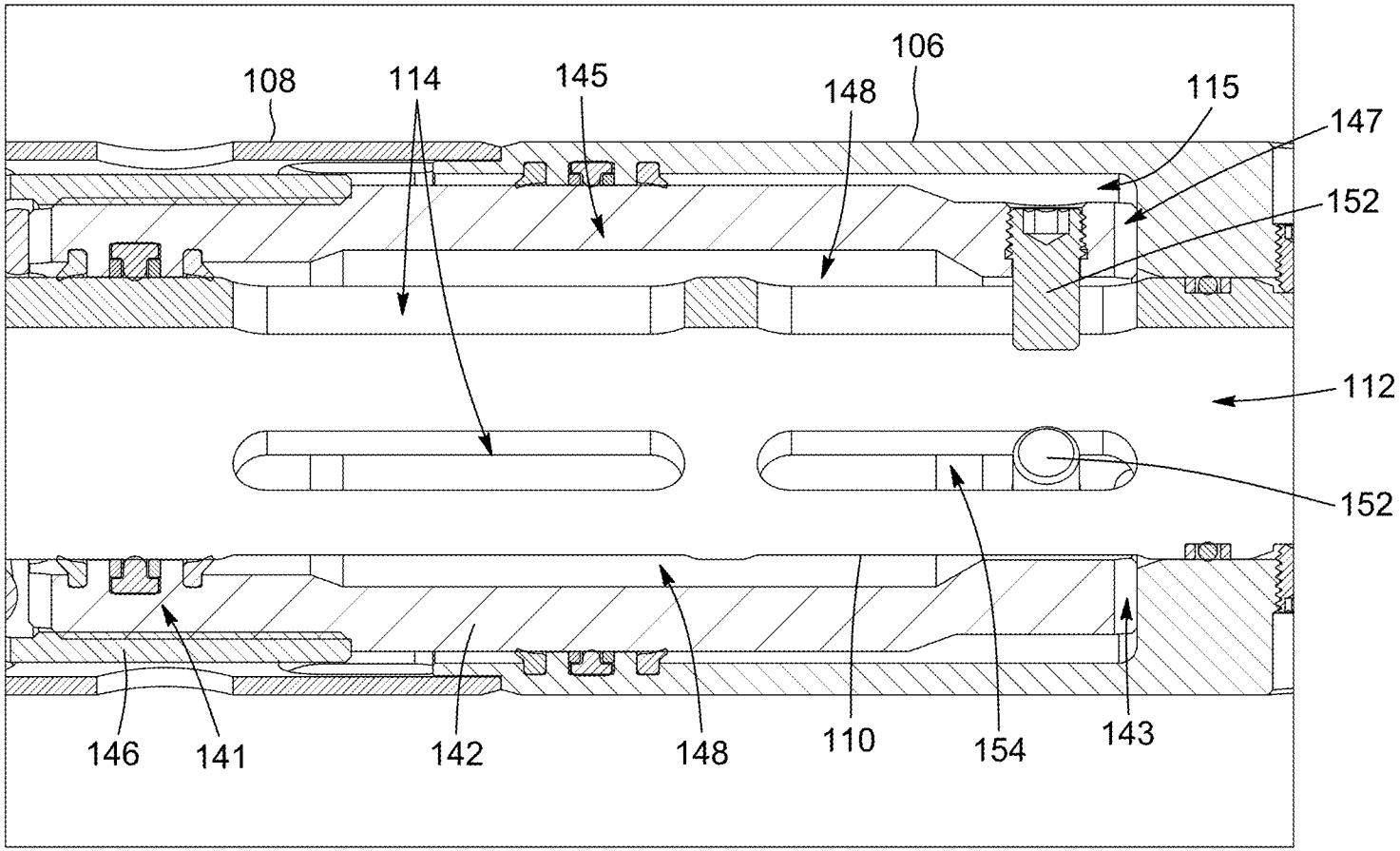
FIG. 11 is an enlarged view of the identified section of FIG. 9, showing a piston body mounted about a central mandrel of the hydraulic anchor, according to an implementation.

As illustrated in FIGS. 9 to 11, the central mandrel 110 can be positioned within the outer wall 108 and extend therethrough to define therewith an annular region 115. In some implementations, the central mandrel 110 is positioned concentrically within the outer wall 108 such that the annular region 115 has a generally constant width around the central mandrel 110. The anchoring tool 100 can further include an anchor assembly 120 positioned within the annular region 115 and slidably mounted to the central mandrel 110. As will be described further below, the anchor assembly 120 is adapted to move relative to the housing 102 and the central mandrel 110 by sliding along the central mandrel 110 within the annular region 115. Additionally, in this implementation, the anchoring tool 100 includes a piston assembly 140 positioned within the annular region 115 and slidably mounted to the central mandrel 110. In a similar fashion to the anchor assembly 120, the piston assembly 140 is adapted to move relative to the housing 102 and the central mandrel 110 by sliding along the central mandrel 110 within the annular region 115. Moreover, the anchor assembly 120 and the piston assembly 140 can also move independently from one another within the annular region 115. In other words, the anchoring tool 100 includes three sub-assemblies, i.e., the housing 102 and central mandrel 110, the anchor assembly 120, and the piston assembly 140, configured to move independently from one another along the wellbore, with the anchor and piston assemblies 120, 140 being further adapted to move within the annular region.

Figure 12:
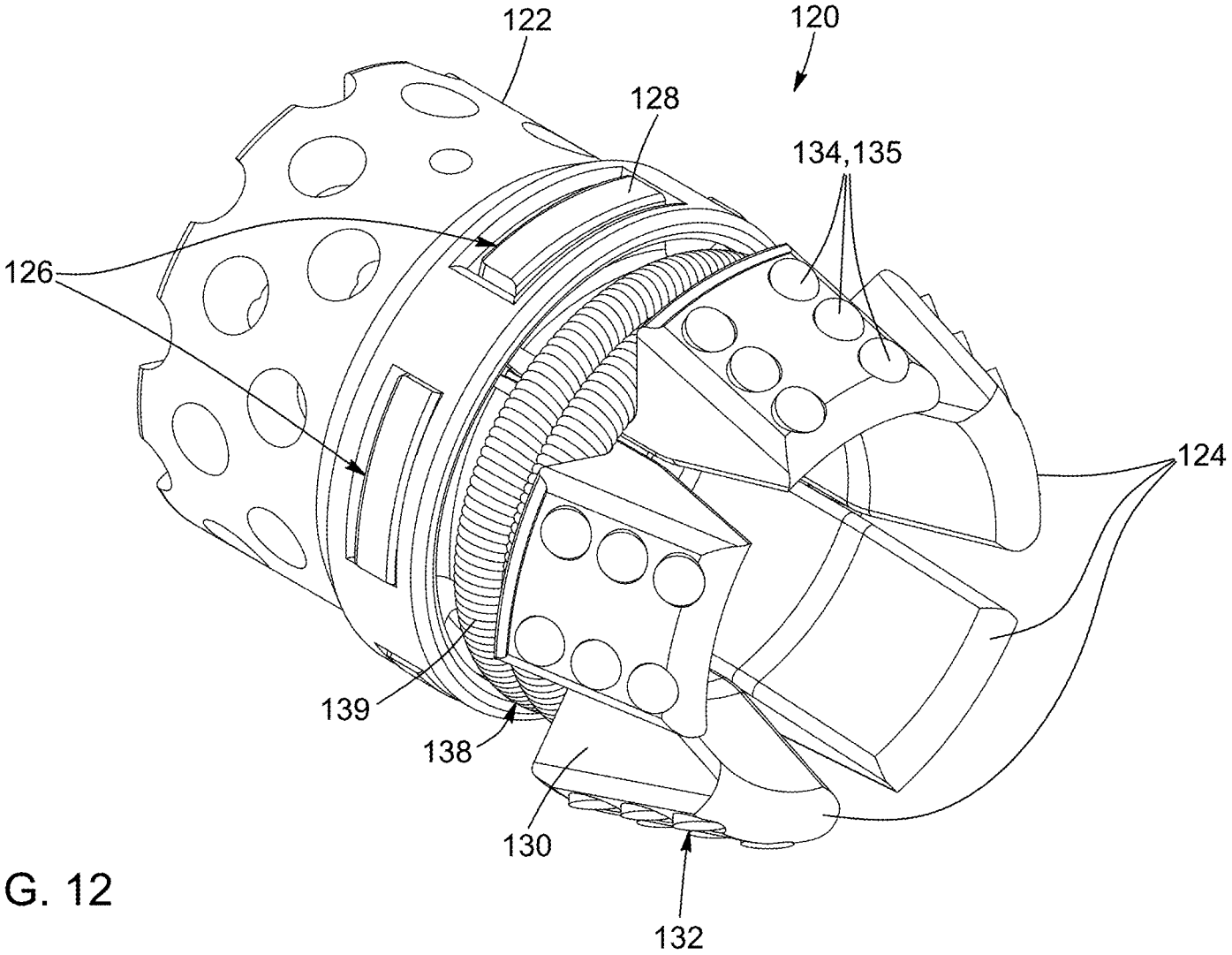
FIG. 12 is a perspective view of the anchor assembly, showing a plurality of anchors arranged about an anchor carrier, according to an implementation.
Figure 13:
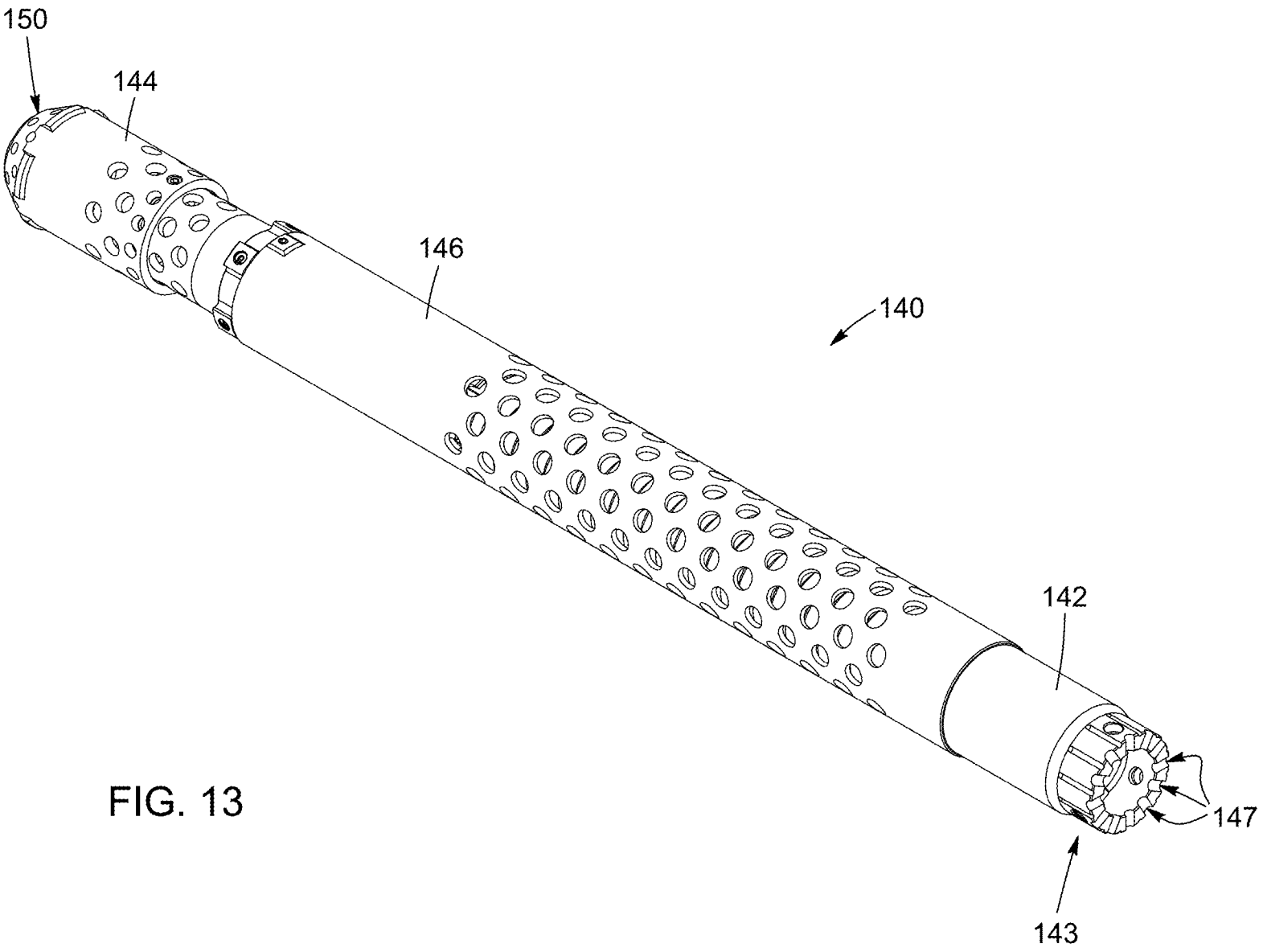
FIG. 13 is a perspective view of the piston assembly, showing the piston body at a first end thereof, and the setting cone at a second end thereof, according to an implementation.

With reference to FIGS. 10, 12 and 14 to 16, in this implementation, the anchor assembly 120 shown in FIG. 12 includes an anchor carrier 122 slidably coupled to the central mandrel 110, and an anchor 124 pivotally connected to the anchor carrier 122 and adapted to move along the central mandrel 110 with the anchor carrier 122. The anchor 124 is operable between a disconnected position where the anchor 124 is spaced from the casing 11 of the wellbore (seen in FIG. 14), and a connected position where the anchor engages the casing 11 of the wellbore (seen in FIGS. 15 and 16). It is noted that when in the disconnected position, the anchoring tool 100 is free to be deployed downhole and move along the wellbore, and that when in the connected configuration, the anchor assembly 120 is secured to the casing 11. In some implementations, the anchor carrier 122 is generally tubular and is adapted to conform to the shape of the central mandrel 110 to facilitate movement of the anchor assembly 120 along the central mandrel 110 (significance of this movement along the mandrel will be explained below).

Moreover, the anchor assembly can include guiding elements configured to guide the anchor assembly during operation thereof, i.e., during displacement of the anchor carrier along the central mandrel 110. In this implementation, and with reference to FIG. 16, the guiding elements include guiding pins 123 coupled to the anchor carrier 122 and extending into respective guiding grooves 125 defined along the central mandrel 110. The anchor carrier 122 can include any suitable number of guiding pins 123, which can be provided circumferentially around the anchor carrier. It is appreciated that the central mandrel 110 includes a corresponding number of guiding grooves. Furthermore, each guiding groove 125 is shaped and adapted to prevent rotational movement of the anchor carrier 122 about the central mandrel 110. Moreover, the guiding grooves 125 can be adapted to limit the range of motion of the anchor carrier 122 along the central mandrel 110 within the annular region 115. For example, the guiding pin 123 can be adapted to abut at either ends of the guiding groove 125, thereby preventing further movement in that direction. This can be useful in preventing the anchors from moving in an undesired location within the annular region 115 and malfunctioning, for example. It should be noted that other implementations are possible for keeping the anchor assembly at desired locations and/or in desired configurations, such as having the guiding pins 123 be coupled to the outer wall 108, or connecting the anchor carrier to the outer cage in any other suitable manner.

As seen in FIGS. 10 and 12, the anchor carrier 122 can include one or more anchor apertures 126 shaped and adapted to have a portion of the anchor 124 extend therein. In this implementation, the anchor 124 includes a tail portion 128 designed to extend through one of the anchor apertures 126. In some implementations, the tail portion 128 is adapted to hook onto the anchor aperture 126 thereby connecting the anchor 124 to the anchor carrier 122. Therefore, it is noted that movement of the anchor carrier 122 also displaces the anchor 124 connected thereto. In addition, the anchor 124 can include a body portion 130 spaced from the tail portion 128 and comprising an anchor interface 132 adapted to engage the casing of the wellbore when the anchor 124 is operated in the connected configuration. More specifically, the anchor interface 132 includes one or more grips 134, such as protrusions 135 extending from the body portion 130 and configured to grip into the surface of the casing when engaged therewith. In this implementation, the anchor interface 132 includes six protrusions 135 positioned a two generally parallel rows on the anchor body 130. However, it is appreciated that other configurations are possible.

In some implementations, the anchor 124 is adapted to pivot in a manner such that the body portion 130 protrudes from within the annular region 115 (e.g., from within the housing 102) to engage the casing. As illustrated in FIG. 10, the anchor 124 can include a partially curved bottom surface 136. In particular, the bottom surface 136 is spaced from the central mandrel 110 proximate the tail portion 128, thereby enabling a see-saw motion of the anchor 124. It is thus noted that the tail portion 128 is allowed to vertically drop, which urges the body portion 130 at the opposite end of the anchor 124 upwardly (or vice-versa) to allow the anchor interface 132 to engage the casing. The tail portion 128 extending through the anchor aperture 126 guides the see-saw motion of the anchor 124 on the central mandrel 110 and maintains the anchor 124 in a desired position on the anchor carrier 122 and on the central mandrel 110. Furthermore, when in the disconnected position (seen in FIG. 10), the bottom surface 136 below the body portion 130 can be tapering upwardly such that it is spaced from the central mandrel 110. As will be described further below, the piston assembly 140 is operable to have an element thereof extend in the space below the body portion 130 of the anchor 124 to urge the body portion 130 radially outwardly to engage the casing.

Figure 7A:
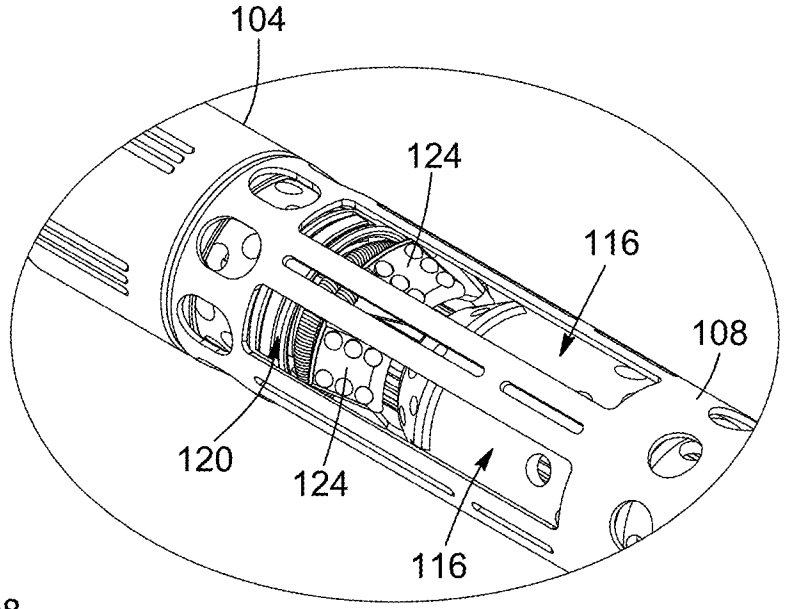
FIG. 7A is an enlarged view of an anchor assembly shown in FIG. 7, showing one or more anchors of the hydraulic anchor, according to an implementation.
Figure 7:
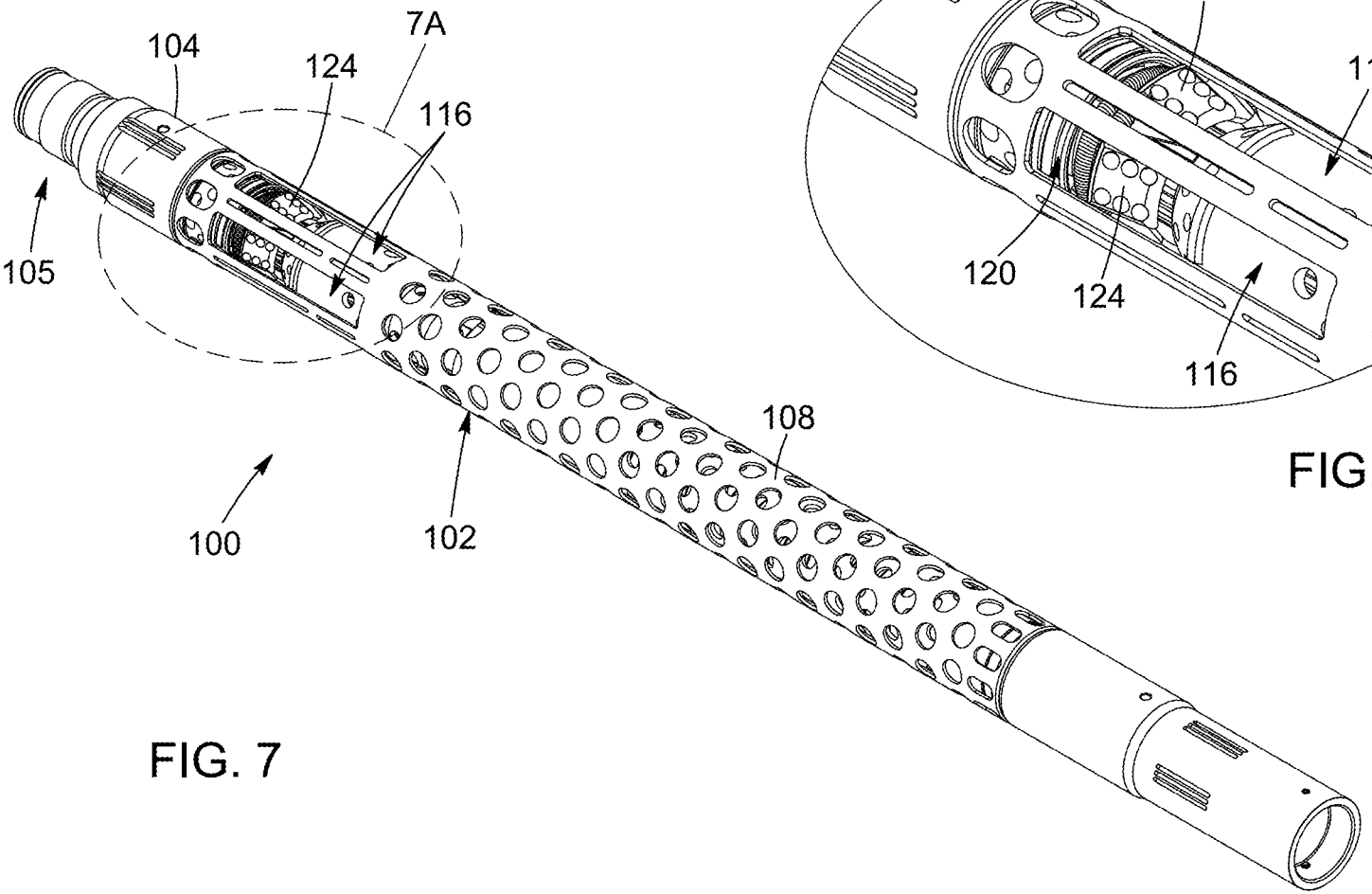
FIG. 7 is a perspective view of a hydraulic anchor of the bottomhole assembly, according to an implementation.
Figure 8:
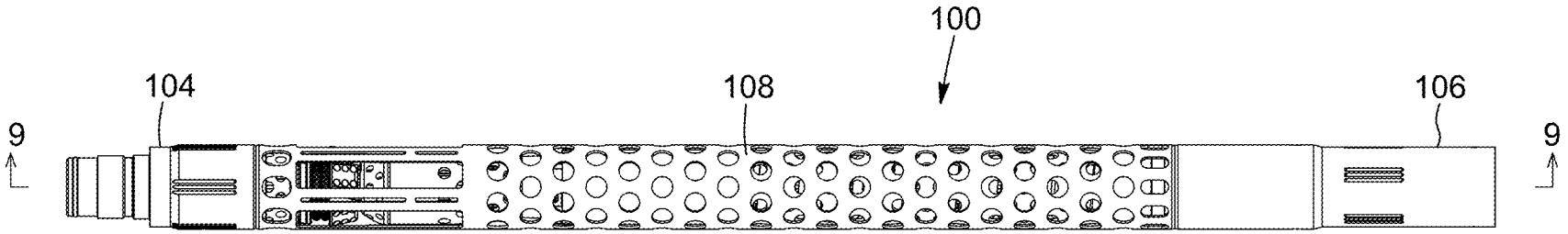
FIG. 8 is a side view of the hydraulic anchor shown in FIG. 7, showing the various parts of a tubular housing, according to an implementation.

In some implementations, such as the implementation of FIG. 12, the anchor assembly 120 includes a plurality of anchors 124 provided around the central mandrel and being operable to engage the casing at various locations around the stroker tool. In this implementation, the anchor assembly 120 includes five anchors 124 which are provided at regular intervals around the central mandrel. However, it is appreciated that any number of anchors provided at any suitable interval around the central mandrel can be used. As mentioned, the anchors 124 are operable to pivot (e.g., the described see-saw motion) to have the body portion 130 extend out of the annular region 115 and through the housing 102 in order for the anchor interface 132 to engage the casing. With reference to FIGS. 7 and 7A, the housing 102 can be provided with elongate slots 116 positioned side-by-side and around the outer wall 108. Each elongate slot 116 aligns with one of the anchors 124 of the anchor assembly 120 and is shaped and adapted to allow the anchor 124 to extend therethrough, for example, for operating the anchors 124 in the connected configuration.

In some implementations, and as seen in FIGS. 10 and 12, the anchor assembly 120 comprises a biasing element 138 coupled to the anchors 124 and configured to bias the anchors 124 in the disconnected position. As such, when disengaging the piston assembly 140 from the anchor assembly 120, the anchors 124 are pulled downwardly via the biasing element 138 in order to release them from the casing 11. In this implementation, the biasing element 138 includes a pair of garter springs 139 coupled about the anchors 124 between the body portion 132 and the tail portion 128. It is noted that positioning the anchors in the connected position stretches the garter springs 139, which exert an inward force on the anchors 124. As such, when the piston assembly is disengaged, the garter springs 139 are adapted to revert the anchors 124 back to the disconnected position. It should be noted that other configurations and/or components are possible and may be used to enable the anchors to return to the disconnected/retracted position after having been engaged with the casing (e.g., in the connected/extended position).

In some implementations, the piston assembly is operable to engage the anchor assembly 120 and operate the anchor 124 from the disconnected position to the connected configuration. More specifically, and with reference to FIGS. 9 to 11 and 13, the piston assembly 140 includes a piston body 142 and a piston head 144 slidably coupled to the central mandrel 110, and a piston cage 146 extending between and securing the piston body 142 and piston head 144 to one another. As seen in FIG. 11, the piston body 142 is shaped in a manner to define a piston chamber 148 in fluid communication with the mandrel passage 112 such that fluid flowing along the central mandrel 110 (e.g., pumped downhole from the surface) can flow into the piston chamber 148. More particularly, the piston body 142 is sealingly coupled to the central mandrel 110 at least at one of a top end 141 and a bottom end 143 thereof, with a central portion 145 being spaced from the central mandrel 110 and defining the piston chamber 148. The central mandrel 110 can be provided with one or more mandrel apertures 114 opening into the piston chamber 148 for establishing fluid communication between the mandrel passage 112 and the piston chamber 148.

As seen in FIG. 11, the piston body 142 can be provided with a plurality of hydraulic slots defined at the downhole end 143 thereof, between the piston body 142 and the bottom sub 106. The hydraulic slots 147 can be adapted to prevent a seal from forming between the piston body 142 and the bottom sub 106, e.g., when the bottom sub abuts the piston body 142 in the mechanically set configuration.

In this implementation, the piston body 142 is hydraulically operated via an ingress of fluid in the piston chamber 148 to engage the anchor assembly 120. In other words, fluid flows into the piston chamber 148 to create hydraulic pressure adapted to displace the piston body 142 (e.g., slide) along the central mandrel 110. The piston head 144, being coupled to the piston body 142 via the piston cage 146, also slides along the central mandrel 110 and is adapted to engage the anchor assembly 120. In some implementations, and with reference to FIGS. 10 and 14 to 16, the piston head 144 is adapted to extend into the space below the body portion 130 of the anchor 124, and is shaped to urge the body portion 130 outwardly for connection with the wellbore (e.g., to operate the anchor 124 in the connected configuration). In this implementation, the piston head 144 includes a setting cone 150 provided at the uphole end of the piston assembly 140. It should thus be understood that the setting cone 150 corresponds to the component of the piston assembly 140 which engages the anchor assembly 120 for displacing the anchors 124. In some implementations, the setting cone 150 has a tapered outer surface 151 configured to extend in the space below the body portion 130 of the anchor 124. During engagement of the anchor 124 by the setting cone 150, as seen in FIG. 15, the tapered surfaces of each component cooperate with one another to urge the anchor 124 upwardly for engaging the anchor interface 132 with the casing. The angle of the tapered outer surface 151 can be substantially the same as the angle of the tapered bottom surface 136 of the anchor 124, for example. However, it is appreciated that other configurations are possible and can be used.

Referring back to FIG. 11, the piston assembly can include guiding elements configured to guide the piston assembly during operation thereof, i.e., during displacement of the piston body and piston head along the central mandrel 110. In this implementation, the guiding elements include guiding studs 152 coupled to the piston body 142 and extending into respective guiding channels 154 defined along the central mandrel 110. The piston body includes three guiding studs 152 provided circumferentially around the piston body, and illustratively provided proximate the bottom end 143 thereof. It is appreciated that the central mandrel 110 includes a corresponding number of guiding channels, e.g., three guiding channels 154 in the present implementation. Furthermore, each guiding channel 154 is shaped and adapted to prevent rotational movement of the piston body 142 about the central mandrel 110. Moreover, the guiding channels 154 can be adapted to limit the range of motion of the piston assembly 140 along the central mandrel 110 within the annular region 115. For example, the guiding stud 152 can be adapted to abut at either ends of the guiding channel 154, thereby preventing further movement in that direction. This can be useful in preventing over extension of the setting cone 150 below the anchors 124, potentially damaging the anchor assembly. In some implementations, the guiding channels 154 can be defined in a thickness of the central mandrel 110, or can include openings communicating with the piston chamber 148. As such, it should be noted that the guiding channels 154 can also act as mandrel apertures 114.

Figure 14:
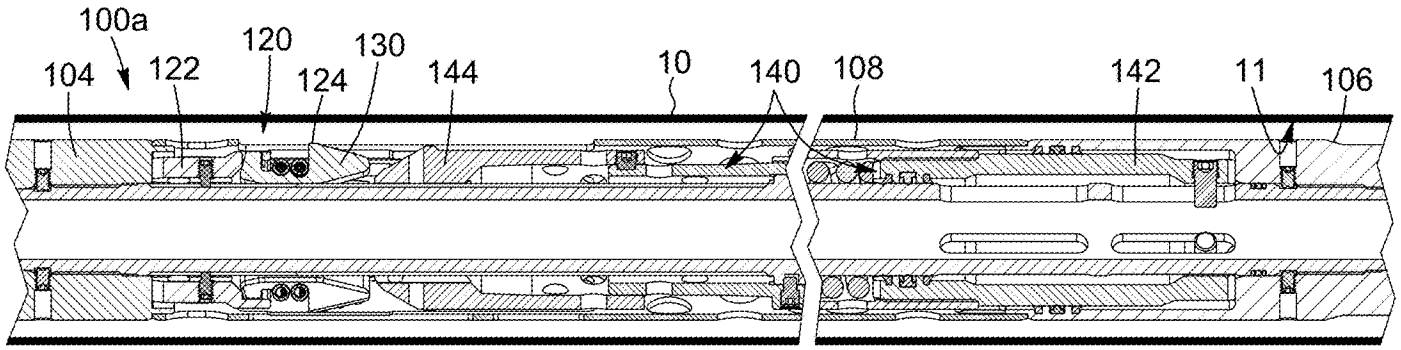
FIGS. 14 to 16 are partially cut cross-sectional views of the hydraulic anchor shown in FIG. 8, showing a cooperation between the piston assembly and the anchor assembly when the hydraulic anchor is in the run-in configuration (FIG. 14), the pre-set configuration (FIG. 15) and the set configuration (FIG. 16), according to possible implementations.
Figure 15:
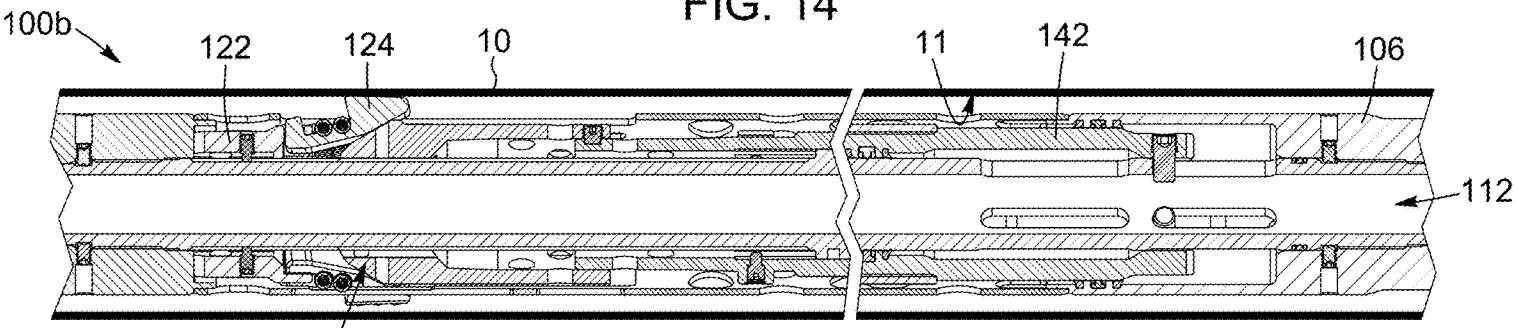
Figure 16:
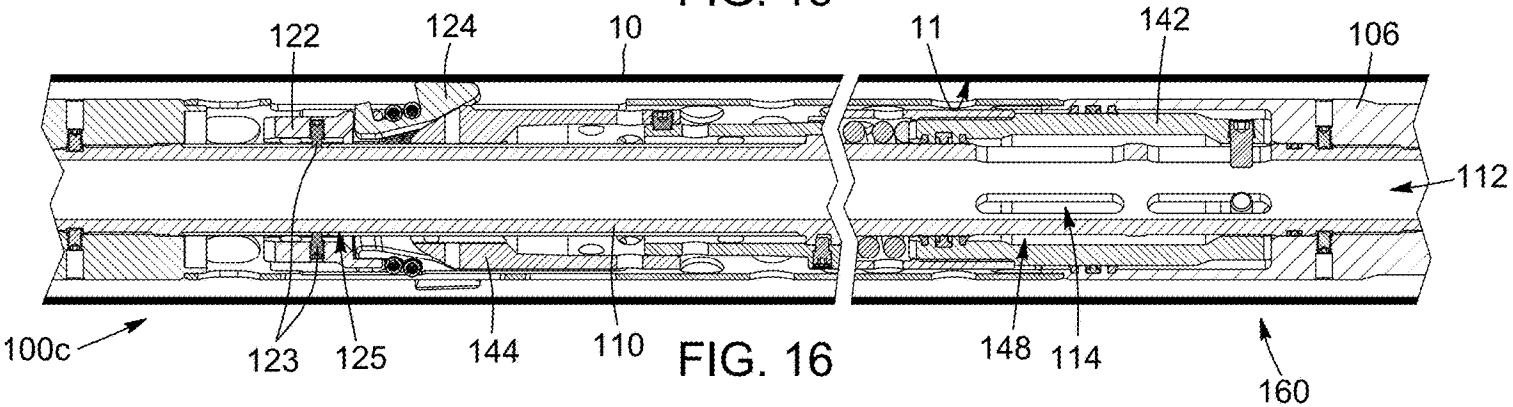

With reference to FIGS. 14 to 16, the different configurations of the anchoring tool 100 will now be described. During deployment of the stroker tool down the wellbore, the anchoring tool 100 is in an unset configuration 100*a* (FIG. 14) which enables movement of the anchoring tool 100 along the wellbore. Once at a desired location down the wellbore, the anchoring tool 100 is operated in a pre-set configuration 100*b* (FIG. 15) where the anchor assembly 120 is secured to the casing. Then, the anchoring tool 100 can be shifted in a set configuration 100*c* (FIG. 16) where the anchoring tool 100 defines a mechanical brace 160 of the stroker tool configured to enable at least one other component of the stroker tool to brace against the mechanical brace 160 (e.g., against the anchoring tool 100) and generate a force in a direction opposite the anchoring tool 100. As will be described further below, the actuator 200 (seen in FIG. 17) is operatively coupled to the anchoring tool 100 and is configured to expand along the wellbore. With the anchoring tool 100 in the set configuration 100*c*, the actuator 200 is adapted to brace against the anchoring tool 100, and is therefore at least partially restricted to expand downhole.

In some implementations, operating the anchoring tool 100 from the unset configuration 100*a* to the pre-set configuration 100*b* includes actuating the piston assembly 140 in order to move the anchor 124 in the connected position. As described above, the piston assembly 140 is hydraulically operable to engage the anchor assembly 120 for displacing the anchor 124 outwardly through the housing 102 to engage and secure the anchor 124 to the casing. As such, the pre-set configuration 100*b* can also be referred to as the "hydraulically set configuration" of the anchoring tool 100. It is noted that in the pre-set configuration 100*b*, the piston assembly 140 is physically engaged with the anchor assembly 120, which is secured to the casing. The housing is then adapted to shift (e.g., be displaced) uphole such that the bottom sub 106 abuts the piston body 142, thereby operating the anchoring tool 100 in the set configuration 100*c* and defining the mechanical brace 160. It should be understood that, in the set configuration 100*c*, also referred to as the "mechanically set configuration", the housing 102, or a portion thereof (e.g., the bottom sub 106), physically engages the piston assembly 140 (e.g., the bottom sub 106 abuts the piston body 142), which is engaged with the anchor assembly 120 secured to the casing. It is thus noted that the housing, piston assembly 140 and anchor assembly 120 are adapted to form the mechanical brace 160, and that other components of the bottomhole assembly (e.g., the actuator) can brace against the mechanical brace 160 to generate a downhole force. It should be noted that, as used herein, the expressions "downhole force", "uphole force", "force in the downhole direction" and/or "force in the uphole direction" can refer to a force adapted to urge a component in the corresponding direction. For example, in some implementations, the actuator is adapted to brace against the mechanical brace 160 to generate a downhole force, or "a force adapted to displace a component connected to the actuator downhole along the wellbore". A person skilled in the art will appreciate that a force is also applied on the mechanical brace, although that force will not generate movement since the mechanical brace is secured to the casing of the wellbore.

Still referring to FIGS. 14 to 16, when in the unset configuration 100*a* (FIG. 14), the anchor assembly 120 is positioned proximate the top sub 104, for example, with the anchor carrier 122 abutting the top sub 104 and the anchors 124 in the disconnected position within the annular region 115. The piston assembly 140 is positioned proximate the bottom sub 106, for example, with the piston body 142 abutting the bottom sub 106 and the anchor head 144 being spaced from the anchors 124. The piston assembly 140 can then be operated via fluid pressure to displace the piston body 142 and piston head 144 along the central mandrel 110 within the annular region 115. The piston chamber 148 is shaped and adapted to receive an ingress of fluid therein, which generates hydraulic pressure sufficient to move the piston assembly 140 toward the anchor assembly 120 (e.g., in the uphole direction). In some implementations, the piston actuation pressure, e.g., the pressure required within the piston chamber 148 to move the piston assembly 140, can be between about 250 psi and 1000 psi, for example. The setting cone 150 then extends below the body portion 130 of the anchors 124 to urge the anchors 124 outwardly through the housing 102 for engagement with the wellbore 10 (i.e., with the casing). This configuration corresponds to the hydraulically set configuration 100*b*, illustrated in FIG. 15, in which the piston assembly 140 is now spaced from the bottom sub 106 and is engaged with the anchor assembly 120. It should be noted that the anchor assembly 120 is secured to the casing and is adapted to prevent further uphole movement of the piston assembly 140.

From the hydraulically set configuration 100*b*, the anchoring tool 100 is operable in the mechanically set configuration 100*c* seen in FIG. 16. In this implementation, the housing 102 and the central mandrel 110 are displaceable relative to the anchor and piston assemblies 120, 140. More specifically, the housing 102 can be moved uphole due to the space created between the piston body 142 and the bottom sub 106 upon operation of the piston assembly 140. As seen in FIG. 16, when in the mechanically set configuration 100*c*, the bottom sub 106 abuts the piston body 142 once more, and the top sub 104 is spaced from the anchor carrier 122. In this implementation, the elongate slots of the outer wall 108 are sized and adapted to enable movement of the housing 102 relative to the anchors 124. In other words, the housing 102 can move along the wellbore without interfering (e.g., contacting) the anchors 124 secured to the casing 11.

Figure 17:
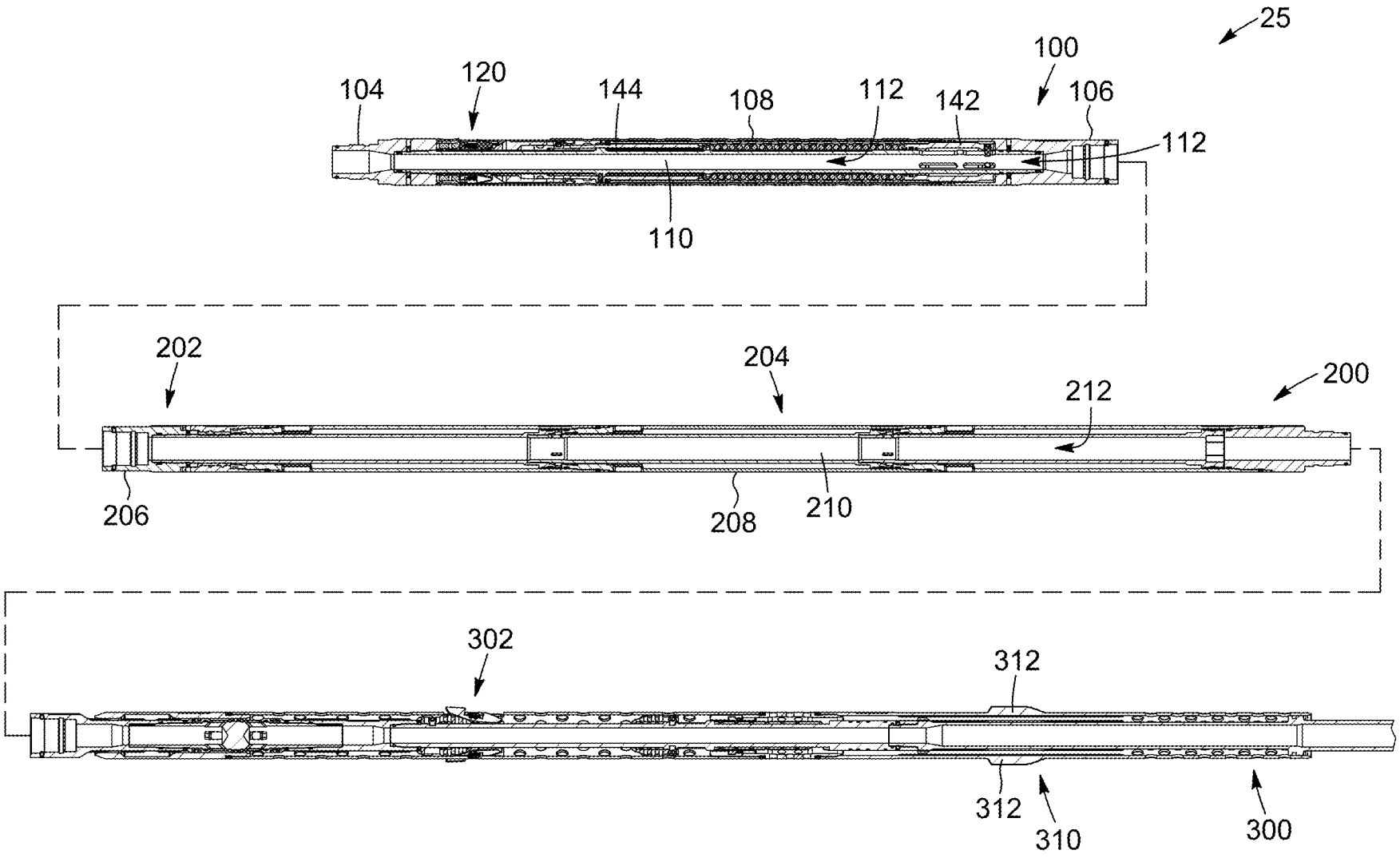
FIG. 17 is a cross-sectional view of the bottomhole assembly, showing the hydraulic anchor, an actuator and a shifting tool connectable to one another, according to an implementation.
Figure 18:
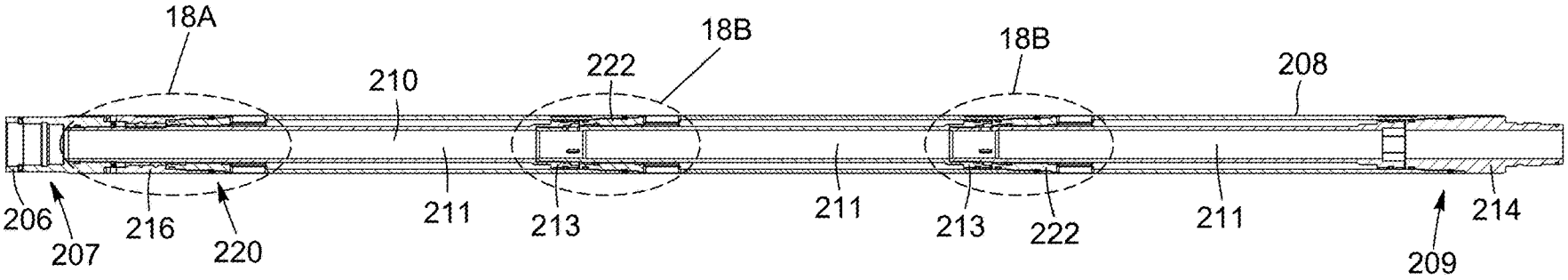
FIG. 18 is a cross-sectional view of the actuator shown in FIG. 17, showing the actuator in a retracted configuration.
Figure 19:
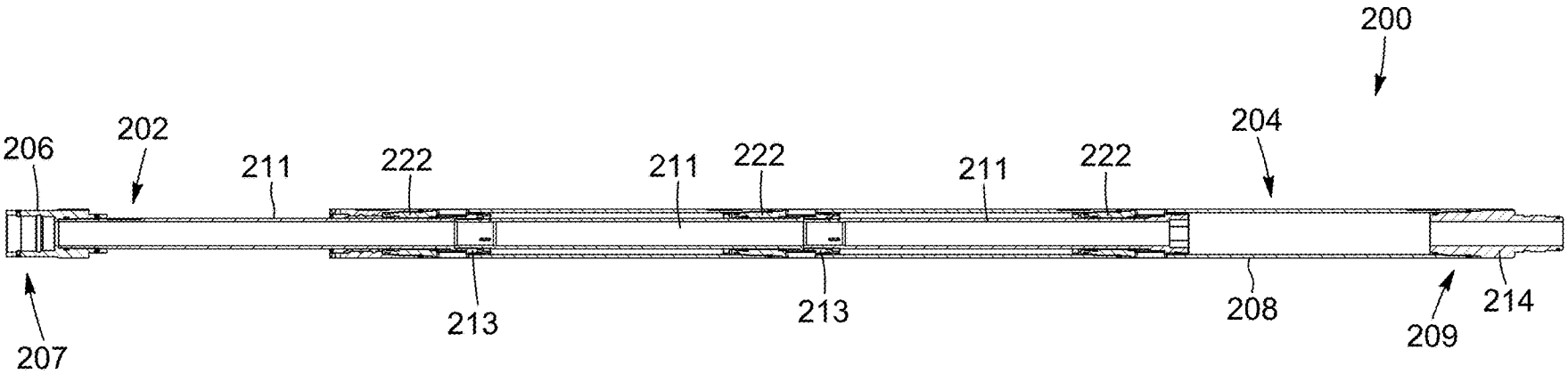
FIG. 19 is a cross-sectional view of the actuator, showing the actuator in an expanded configuration, according to an implementation.

As previously noted, when in the mechanically set configuration 100*c*, the housing 102, piston assembly 140 and anchor assembly 120 define the mechanical brace 160, such that other components of the stroker tool (e.g., the actuator) can brace against the mechanical brace 160 to generate a downhole force. With reference to FIGS. 17 to 19, an implementation the stroker tool 25 includes the anchoring tool 100, the actuator 200 and the shifting tool 300. The actuator 200 is adapted to be operatively coupled between the anchoring tool 100 and the shifting tool 300, where the anchoring tool 100 is positioned uphole of the actuator 200. In this implementation, the actuator 200 is adapted to be hydraulically operated to generate the mechanical force on components positioned downhole, e.g., the shifting tool 300. As seen in FIGS. 18 and 19, the actuator 200 is operable between a retracted configuration (FIG. 18) and an expanded configuration (FIG. 19) where the actuator 200 is adapted to generate the mechanical force, such as a pushing force, on the shifting tool 300.

In this implementation, the actuator 200 comprises an inner portion 202 coupled to the anchoring tool 100, such as to the housing 102, such as to the bottom sub 106. In addition, the actuator 200 includes an outer portion 204 slidably coupled to the inner portion 202. The outer portion 204 is movable relative to the inner portion and vice versa such that the actuator 200 is operable to expand within the wellbore to generate the downhole pushing force. The inner portion 202 can include an actuator sub 206 provided at the uphole end 207 of the actuator 200, and an actuator mandrel 210 coupled to and extending from the actuator sub 206. The actuator mandrel 210 defines an actuator fluid passage 212 which is in fluid communication with the mandrel passage 112 of the anchoring tool 100. In this implementation, the actuator mandrel 210 can include two or more mandrel sections 211 coupled to one another in an end-to-end manner. As seen in FIGS. 18 to 19, in some implementations, the mandrel section 211 can include a mandrel joint 213 configured to enable connection of a subsequent mandrel section 211 thereto. The subsequent mandrel section 211 can be connected in the preceding mandrel joint 213 via interference fit, via a threaded connection, or via any other suitable connection method.

In this implementation, the outer portion 204 includes an actuator housing 208 slidably connected to the actuator mandrel 210, and a driving sub 214 connected at a downhole end 209 of the actuator 200. In some implementations, the actuator mandrel 210 is concentrically mounted within the actuator housing 208, although it is appreciated that other configurations are possible. It is noted that the inner portion 202, or a portion thereof (e.g., the actuator mandrel 210) and the outer portion 204, or a portion thereof (e.g., the actuator housing 208) define an actuator annular region 215 therebetween.

Figure 18B:
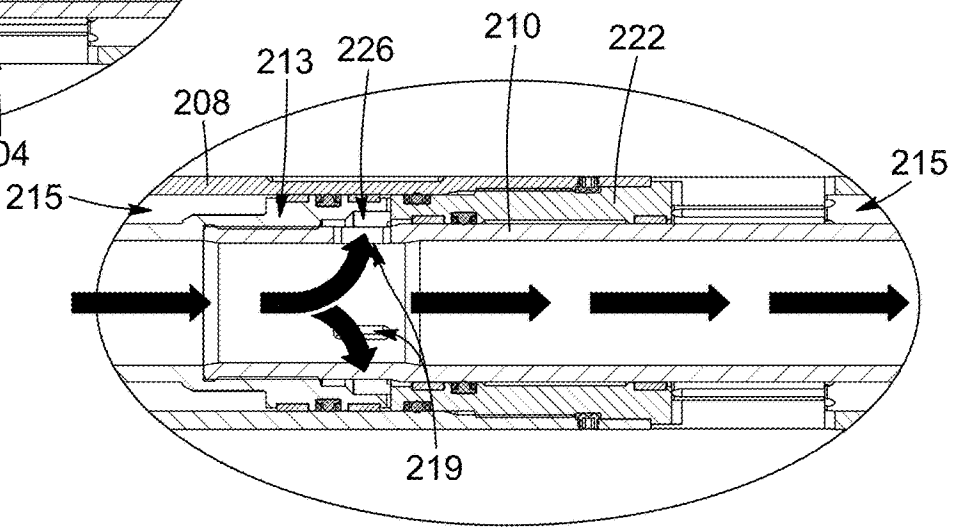
FIGS. 18A and 18B are enlarged views of the corresponding portions shown in FIG. 18, showing a flowpath of pressurized fluid within the actuator, according to an implementation.
Figure 18A:
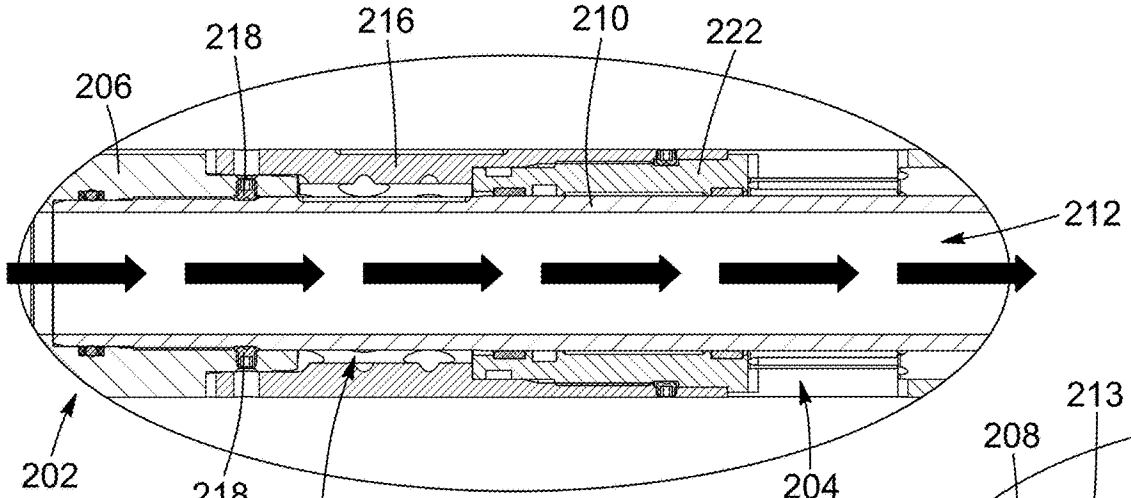

As illustrated in FIGS. 18 and 18A, the actuator housing 208 includes a coupling portion 216 releasably connecting the actuator housing 208 to the actuator sub 206. In other words, the outer portion 204 is connected to the inner portion 202 via the coupling portion 216. The coupling portion 216 is adapted to release the outer portion 204 from the inner portion 202 during operation of the actuator 200, thereby enabling expansion of the actuator 200 (e.g., movement of the inner portion 202 and/or the outer portion 204 relative to one another). In some implementations, the coupling portion 216 is releasably coupled to the actuator sub 206 via shear connectors 218 (e.g., shear pins), and is secured to the actuator housing 208. The shear connectors 218 are configured to break and release the coupling portion 216, and therefore the housing 208, from the actuator sub 206.

The actuator 200 includes an actuating mechanism operable to move the actuator in the expanded configuration and generate the downhole mechanical force adapted to actuate the shifting tool. In this implementation, the actuating mechanism includes an actuator piston assembly 220 operatively coupled to the actuator housing 208 and slidably mounted to the actuator mandrel 210. As illustrated in FIGS. 18 to 19, the actuator piston assembly 220 is at least partially mounted within the actuator annular region 215. More specifically, in this implementation, the actuator piston assembly 220 includes an annular piston head 222 slidably mounted to the actuator mandrel 210 within the actuator annular region 215 and secured to the actuator housing 208. The annular piston head 222 is in fluid communication with the actuator passage 212 such that fluid flowing through the stroker tool can apply hydraulic pressure on the annular piston head 222, which slides along the actuator mandrel 210 to push the housing 208 and driving sub 214 downhole. It should thus be noted that the actuator 200 can be a linear actuator adapted to generate an axial force in at least one direction.

In this implementation, the piston assembly 220 includes a plurality of annular piston heads 222 spaced along the actuator mandrel 210. It should therefore be noted that each annular piston head 222 is adapted to have hydraulic pressure applied thereon which generates a greater downhole force (e.g., compared to a single annular piston head 222) for pushing the actuator housing and driving sub 214. As seen in FIG. 18A, the coupling portion 216 can be secured to a portion of the actuator housing and defines therewith an annular chamber 224. More specifically, the annular chamber 224 is defined radially between the coupling portion 216 and the actuator mandrel 210, and axially between the actuator housing and the actuator sub 206.

With reference to FIGS. 18 and 18B, the plurality of annular piston heads 222 can be mounted downhole of the annular chamber 224. In some implementations, the mandrel joints 213 extend outwardly into the actuator annular region 215 to engage the actuator housing 208 uphole of the annular piston heads 222. More particularly, the mandrel joints 213 define respective piston chambers 226 and includes actuator mandrel apertures 219 establishing fluid communication between the piston chambers 226 and the actuator passage 212. Each piston chamber 226 can thus have an ingress of fluid therein (represented by arrows in FIG. 18B) for creating hydraulic pressure on respective annular piston heads 222 provided along the actuator 200. It should thus be understood that each piston chamber provided along the actuator is adapted to generate hydraulic pressure on one of the annular piston heads 222 for operating the actuator 200, e.g., for axially expanding the outer portion 204 downhole. For example, in the illustrated implementation, the actuator 200 includes two annular piston heads 222 such that the hydraulic pressure within the actuator acts on two separate piston surface, thereby generating a greater amount of force to have outer portion slide along the actuator mandrel 210 downhole.

As seen in FIG. 19, once in the expanded configuration, each mandrel joint 213 is adapted to block further downhole movement of the annular piston heads. In other words, the mandrel joints 213 can define stops preventing further downhole movement of the outer portion 204.

Figure 20:
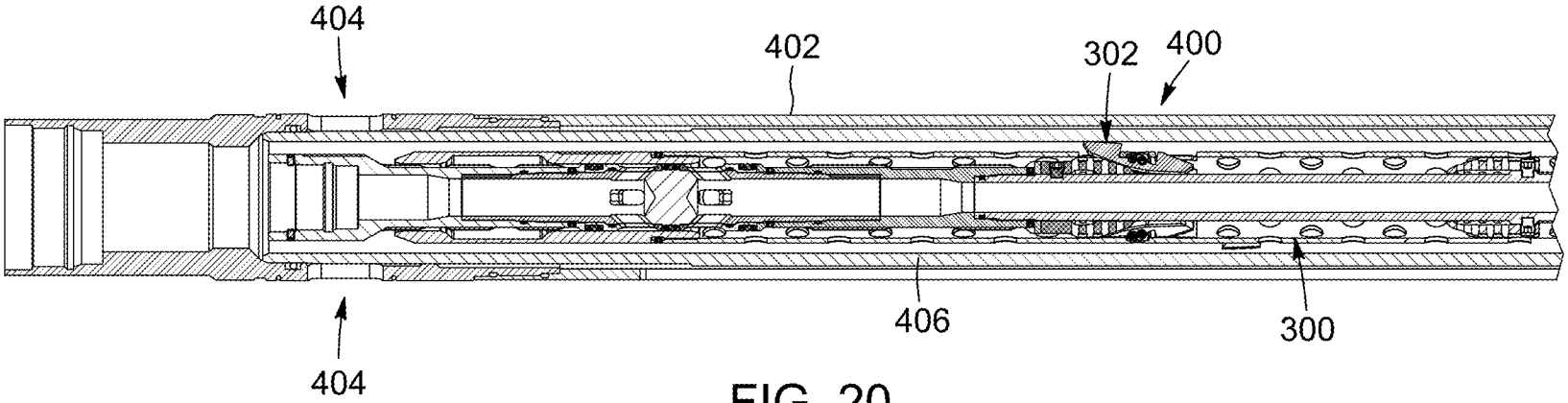
FIGS. 20 and 21 are cross-sectional views of the shifting tool positioned within the valve assembly, with the valve assembly in the closed position (FIG. 20) and shifted in the open position (FIG. 21), according to possible implementations.
Figure 21:
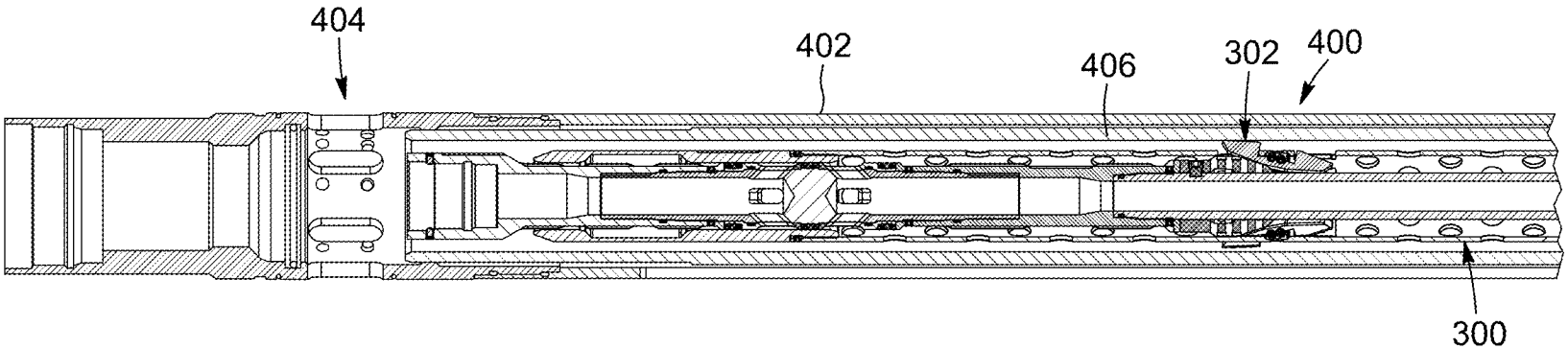

Now referring to FIGS. 20 and 21, in this implementation, the shifting tool 300 is adapted to extend within a valve assembly 400 for shifting the valve assembly 400 into an open configuration, for example. The valve assembly 400 can include a valve housing 402 having a valve port 404 defined therethrough for communicating with the surrounding environment and enabling injection operations, productions operations, or any other suitable operation. The valve assembly 400 further includes a valve sleeve 406 slidably mounted along the valve housing 402 and being adapted to occlude the valve port 404. The valve sleeve 406 is shiftable (e.g., via the shifting tool 300) to uncover the valve port 404, thereby operating the valve assembly 400 in the open configuration.

In this implementation, the shifting tool 300 illustratively includes a gripping portion 302 operable (via hydraulic means, mechanical means, or a combination thereof) to extend outwardly and engage an inner surface of the valve sleeve 406. Once the gripping portion 302 is engaged with the valve sleeve 406, the shifting tool 300 is at least partially secured to the valve sleeve 406. As such, applying a downhole force on the shifting tool 300, for example via operation of the actuator 200, drags the valve sleeve 406 downhole for uncovering the valve port 404. In some implementations, the valve sleeve 406 is releasably secured to the valve housing 402 via shear connectors. In such implementations, greater shifting forces are required for both shearing the shear connectors and shifting the valve sleeve open. Shifting tools are known in the art and will not be described further in this disclosure.

Referring back to FIGS. 14 to 19, in addition to FIGS. 20 and 21, operation of the stroker tool 25 can be gradual. In some implementations, once the shifting tool 300, also referred to as a mechanical anchor, is secured to the valve assembly 400, operation of the anchoring tool 100 and the actuator 200 can be initiated. Fluid can be pumped downhole (e.g., along the tubing string) to flow into the stroker tool 25, thereby increasing the fluid pressure along the components of the stroker tool 25. The anchoring tool 100, also referred to as a hydraulic anchor, can then be hydraulically operated. More specifically, the fluid pressure can increase to an anchoring fluid pressure corresponding to the hydraulic pressure required in the piston chamber 148 to actuate the piston assembly 140 for engaging the anchor assembly 120 (i.e, for operating the anchoring tool in the hydraulically set configuration). The anchoring fluid pressure can be between about 250 psi and 1000 psi, although other anchoring fluid pressures are possible for actuating the piston assembly 140. The stroker tool 25 is therefore connected to the casing proximate an uphole end of the anchoring tool 100 (e.g., via the anchors 124) and connected to the valve assembly 400 proximate a downhole end thereof (e.g., via the shifting tool gripping portion 302).

With the anchoring tool 100 in the hydraulically set configuration 100*b*, the pressure along the stroker tool 25 increases further. Particularly, the pressure within the annular piston chambers 226 of the actuator 200 increases to hydraulically operate the actuator 200. In some implementations, the fluid pressure within the annular piston chambers exerts a force in both the uphole direction (e.g., on the mandrel joint 213 portion of the piston chambers) and the downhole direction (e.g., on the piston head portion of the piston chambers). In other words, as the fluid pressure increases, the actuator 200 is looking to expand between the anchoring tool 100 and the shifting tool 300, and therefore applies a force in both directions.

As the fluid pressure increases, it reaches a setting fluid pressure corresponding to the pressure required to shear the shear connectors 218 securing the coupling portion of the actuator 200, and generate a force adapted to collapse the piston assembly 140 of the anchoring tool 100. In this implementation, the setting fluid pressure is greater than the anchoring fluid pressure, but less than a fluid pressure required to shift the valve sleeve via operation the actuator and shifting tool. For example, the setting fluid pressure can be between about 1000 psi and about 3000 psi, although other configurations are possible. Therefore, it is noted that the hydraulic pressure within the actuator 200 generates the force required to push the housing 102 of the anchoring tool 100 uphole to have the bottom sub 106 abut against the piston assembly 140. With the bottom sub of the housing 102 abutting the piston assembly 140, the anchoring tool 100 is operated in the mechanically set configuration 100*c* and defines the mechanical brace 160. As previously described, the mechanical brace 160 prevents further uphole movement of the stroker tool 25 components in order to generate greater amounts of force in the downhole direction.

With the anchoring tool 100 in the mechanically set configuration 100*c*, the pressure along the stroker tool 25 increases further and reaches a shifting fluid pressure corresponding to the fluid pressure required to shear the shear connectors of the valve sleeve and enable downhole movement of the outer portion 204 of the actuator, of the shifting tool 300 and of the valve sleeve. For example, the shifting fluid pressure can be between about 6000 psi and 10000 psi, such as between about 7000 psi and 9000 psi, such as about 8000 psi, although other configurations are possible. As the actuator 200 braces up against the mechanical brace 160, it is hydraulically operated in the expanded configuration where the outer portion 204 extends axially outwardly to generate the mechanical force required to actuate the shifting tool 300 and open the valve assembly 400.

Figure 28:
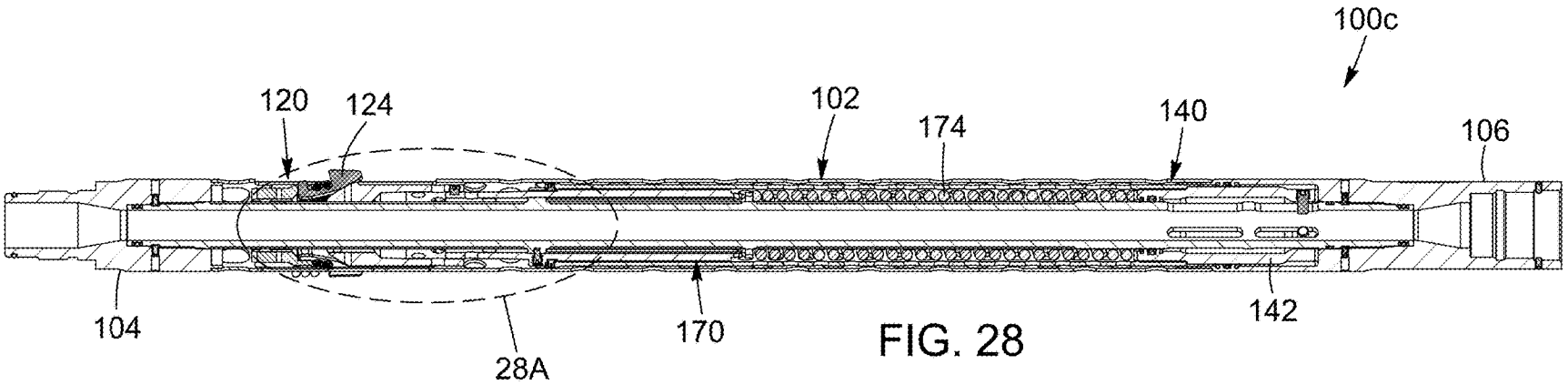
FIGS. 28 to 30 are cross-sectional views of an implementation of the hydraulic anchor, showing a release mechanism adapted to disengage the piston assembly from the anchor assembly, and operate the hydraulic anchor in a reset configuration, according to possible implementations.
Figure 28A:
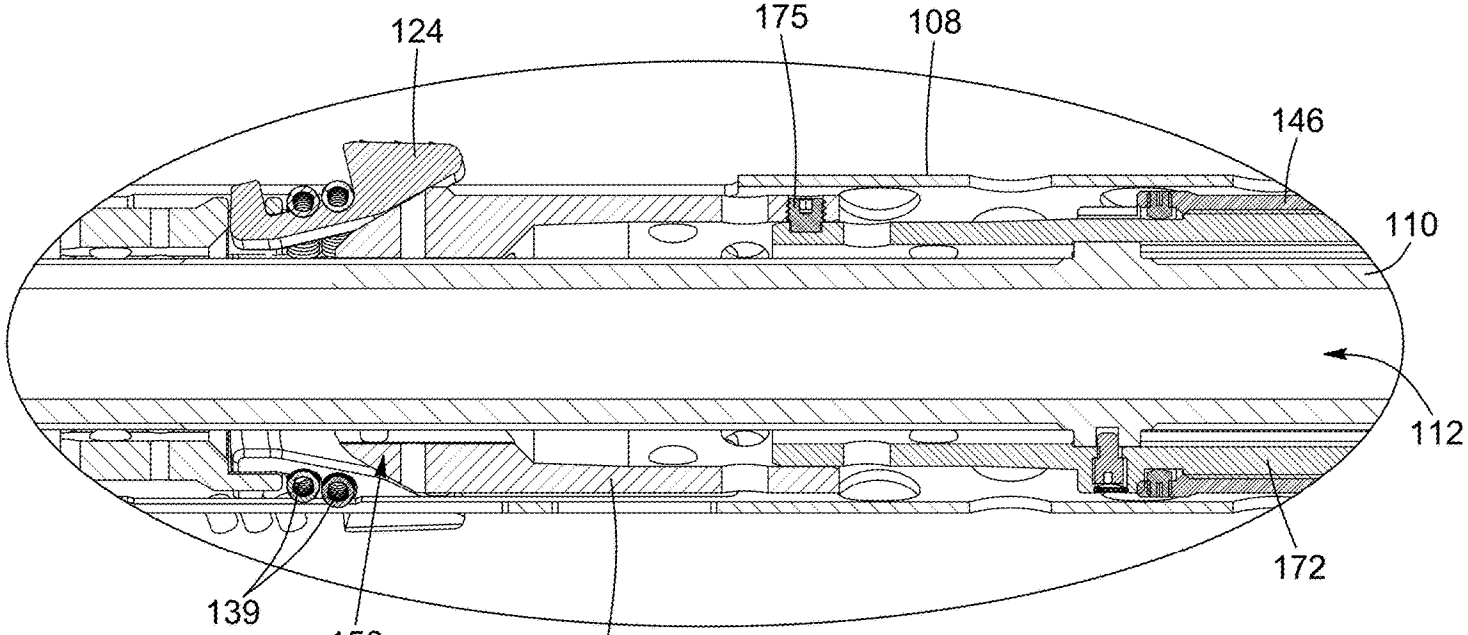
Figure 29:
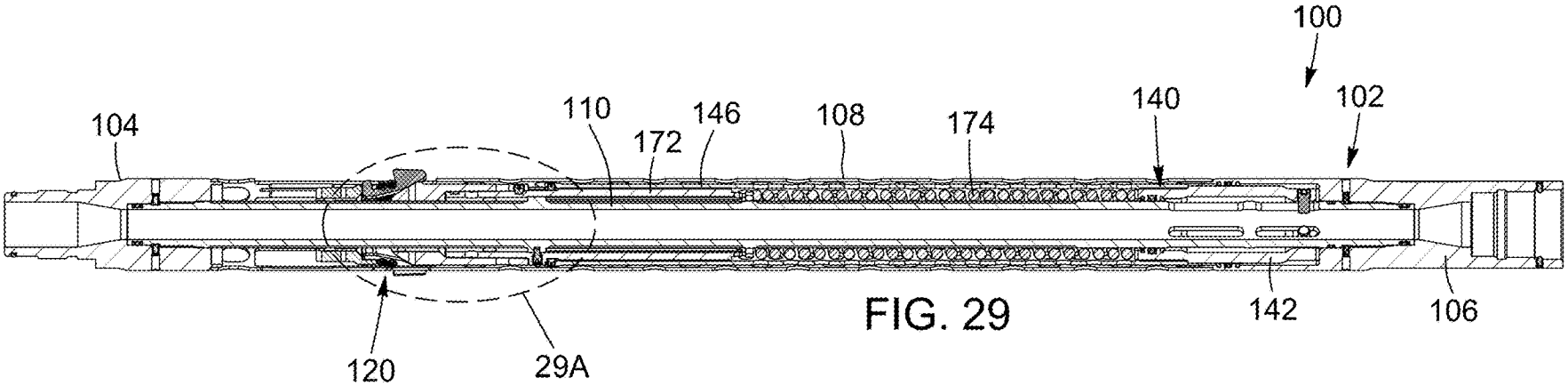
Figure 29A:
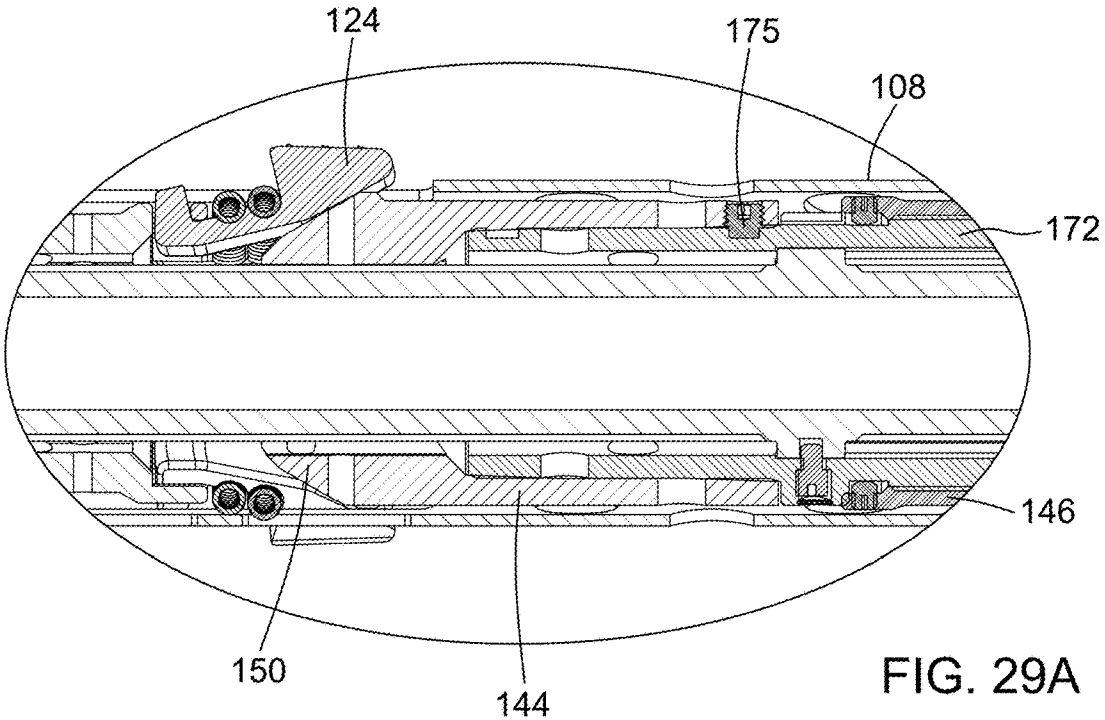
Figure 30:
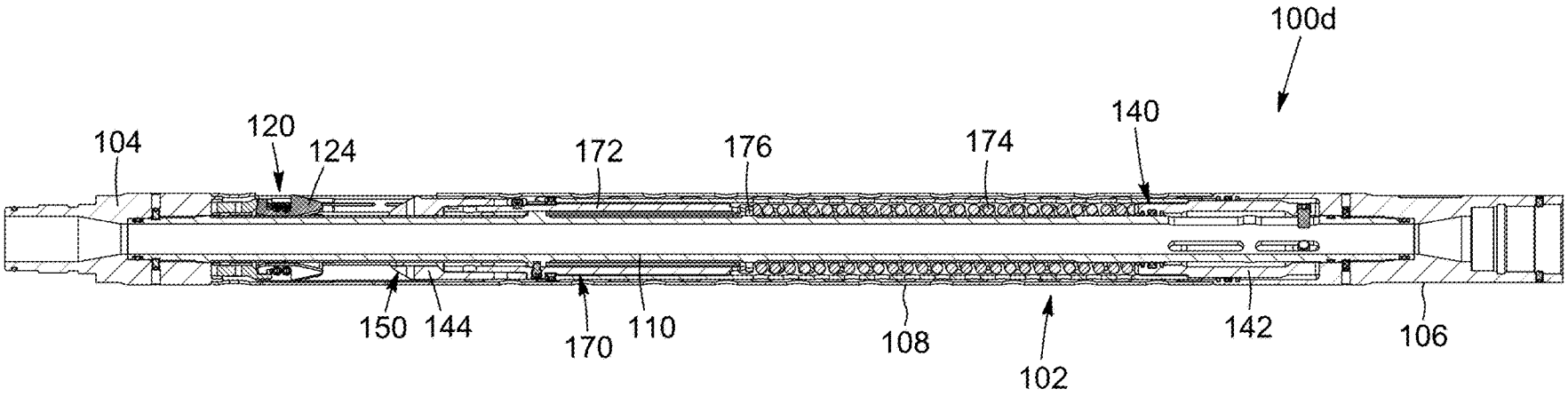

With reference to FIGS. 28 to 30, it is noted that, in some implementations, the anchoring tool 100 comprises a release mechanism 170 operable to disengage the piston assembly 140 from the anchor assembly 120, thereby enabling the anchors 124 to disengage the casing, and position the anchoring tool 100 in a reset configuration 100*d* (illustrated in FIG. 30). In this implementation, the release mechanism 170 includes a release mandrel 172 coupled between the piston head 144 and the piston body 142. The release mandrel 172 is releasably connected to the piston head 144, such as via shear fasteners 175, for example. The shear fasteners 175 are configured to break at a predetermined force threshold to enable to the release mandrel 172 to move relative to the piston head 144. As seen in FIGS. 28A and 29A, the release mandrel 172 is adapted to move toward the setting cone 150 (e.g., in the uphole direction) and be at least partially secured within the piston head 144. In this implementation, the release mandrel 172 has an outer diameter adapted to engage an inner diameter of the piston head 144 such that the release mandrel 172 connects to the piston head 144 via interference fit.

In some implementations, the shear fasteners 175 can be broken via an increase in the force applied by the actuator on the anchoring tool 100. For example, once the valve sleeve has been shifted in the open position, the force generated by the actuator, which is being applied to both the shifting tool and the anchoring tool, can be increased. At a certain force threshold, the shear fasteners 175 break to enable movement of the release mandrel 172 and engagement thereof with the piston head 144. In this implementation, the actuator pushes against the bottom sub, such that the housing 102 of the anchoring tool 100 is displaced uphole. The bottom sub abuts the piston body 142, which is connected to the release mandrel 172 via the piston cage 146. Therefore, applying a force on the housing to move it in the uphole direction generates a corresponding force on the release mandrel 172, and thus on the shear fasteners 175. Once sheared, it should be understood that the release mandrel 172 is adapted to move toward and engage the piston head 144 due to the engagement of the setting cone 150 with the anchors 124, which are secured to the casing of the wellbore.

Once the pressure is bled from within the stroker tool (e.g., after having operated the shifting tool), the anchoring tool 100 can be moved to the reset configuration, where the piston assembly 140 disengages the anchor assembly 120. More specifically, in order to move from the set configuration to the reset configuration, the release mandrel 172 is sheared from its initial position to engage the piston head 144, and the housing 102 of the anchoring tool 100 is subsequently moved downhole, e.g., when the pressure is bled from within the stroker tool, thereby relaxing the actuator and enabling the downhole movement. In this implementation, the release mechanism 170 includes a piston spring 174 provided within the annulus defined between the piston cage 146 and the central mandrel 110. The piston spring 174 is illustratively provided between the release mandrel 172 and the piston body 142, and is adapted to hold the piston body 142 in abutment with the bottom sub 106 as the housing 102 is moved downhole. The central mandrel 110 can include a mandrel shoulder 176 adapted to abut an uphole end of the piston spring 174, with a downhole end of the piston spring 174 abutting the piston body 142. As such, it is noted that moving the housing 102 downhole, which includes moving the top sub, the central mandrel and the bottom sub downhole, correspondingly pushes the piston spring 174 due to the contact with the mandrel shoulder 176, which pushes the piston body 142. Moreover, it should be noted that the piston body 142 is secured to the piston cage 146, which is in turn secured to the release mandrel 172. Therefore, pushing the piston body 142 downhole (along with the housing 102) drags the piston cage 146 and the release mandrel 172 downhole along with it. As described, the release mandrel 172 is secured to the piston head 144 (e.g., via interference fit) and thus drags the piston head 144 and the setting cone 150 downhole and away from the anchor assembly 120.

As the piston assembly 140 is spaced from the anchor assembly 120, it is noted that the garter springs 139 exert an inward force on the anchors 124, which facilitates their movement back in the retracted position (e.g., within the annular region). The overall length of the piston assembly 140 (e.g., from the setting cone 150 to the piston body 142) is illustratively reduced due to the engagement of the release mandrel 172 within the piston head 144. Therefore, the piston assembly 140 is "deactivated" and can no longer engage the anchor assembly 120, i.e., the setting cone 150 can no longer engage the anchor assembly 120 in the space below the anchor body 130. The piston spring 174 can be adapted to limit the uphole movement of the piston assembly 140 (e.g., the spring 174 can be fully compressed, thereby preventing further movement) such that reducing the length of the piston assembly prevents the setting cone 150 from reaching the anchors 124. The reset configuration can be useful once the valve assemblies are open along the wellbore, and the stroker tool is recovered to surface. For instance, "deactivating" the piston assembly 140 prevents the setting cone 150 from inadvertently engaging the anchor assembly 120, which can snag on the casing as the tool is pulled from the wellbore.

In some implementations, the mechanical force generated by the actuator 200 to shift the valve sleeve can result in high impact loading, which can damage various components of the stroker tool 25. For example, the shifting tool 300 can be adapted to abut against a shoulder of the valve assembly once the valve sleeve is shifted open. The continuous influx of pressurized fluid into the actuator 200 generates a generally constant force on the actuator piston assembly 220. It is noted that the generally constant force can continuously accelerate the outer portion until it impacts another component. In other words, the velocity, and therefore the kinetic energy, of the outer portion increases continuously as the actuator is operated. In such implementations, the combined mechanical force and kinetic energy pushing on the shifting tool 300 can cause the shifting tool to impact the valve shoulder at the same velocity as the actuator expands, resulting in an abrupt stop and high impact loading. With reference to FIGS. 22 to 27, the stroker tool 25 can include a flow limiter 500 configured to limit the flowrate of fluid into the actuator 200, thereby reducing the rate at which the pressurized fluid flows into the actuator 200. As such, it should be understood that the actuator 200 operates from the retracted configuration to the expanded configuration at a slower rate, reducing the risks for high impact loads.

In this implementation, the flow limiter 500 is operable between an unrestricted configuration (seen in FIGS. 25 and 26) where fluid flowrate through the flow limiter 500, and thus into the actuator 200, is unrestricted and generally constant, and a restricted configuration (seen in FIG. 27) where fluid flowrate through the flow limiter 500 is at least partially controlled and reduced. The flow limiter 500 includes a limiter housing 502 having an uphole end 503 connectable to the anchoring tool 100, and a downhole end 505 connectable to the actuator 200. The flow limiter 500 also includes a limiter mandrel 510 defining a limiter passage 512 therethrough and in fluid communication with the mandrel passage 112 of the anchoring tool 100 and the actuator passage 212 of the actuator 200. In this implementation, the limiter housing 502 is slidably mounted on the limiter mandrel 510, and operating the flow limiter 500 between the unrestricted and restricted configurations includes displacing the limiter housing 502 relative to the limiter mandrel 510.

Figure 25:
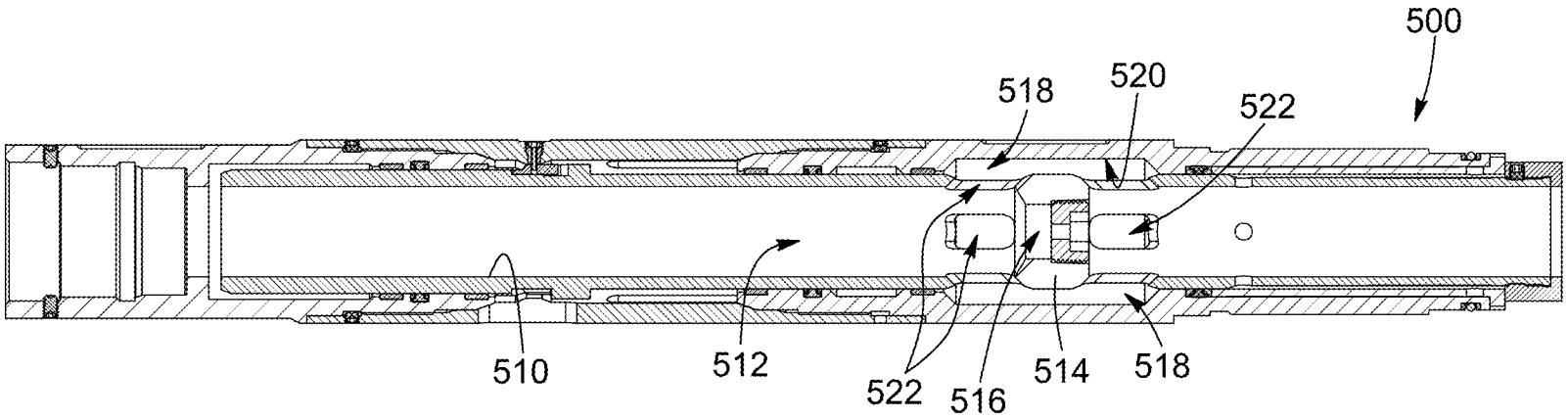
Figure 26:
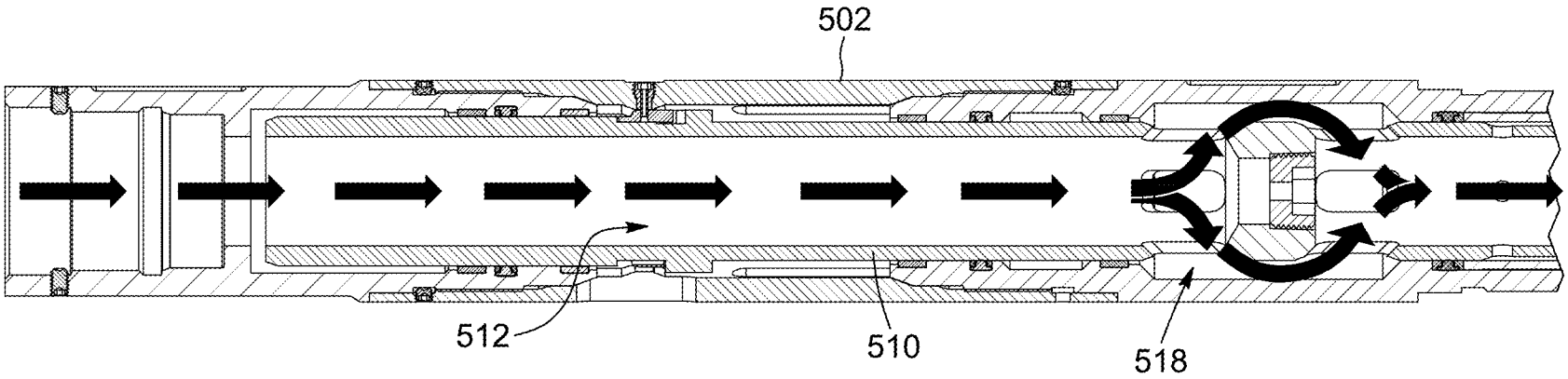
FIGS. 26 and 27 are cross-sectional views of the flow limiter shown in FIG. 23, showing a fluid pathway when the flow limiter is in an unrestricted configuration (FIG. 26) and a restricted configuration (FIG. 27), according to possible implementations.
Figure 27:
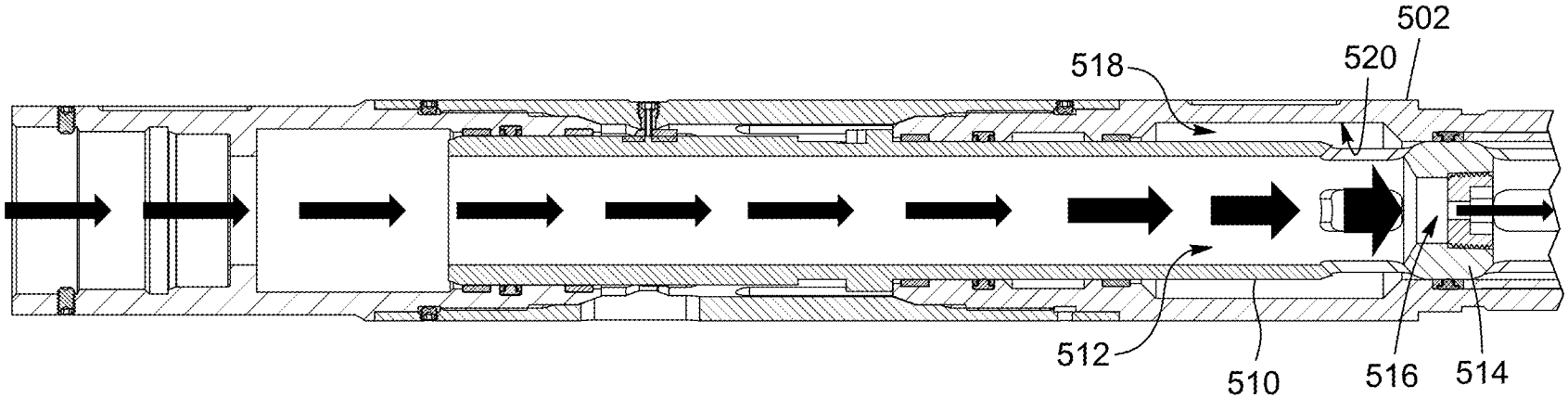

As seen in FIGS. 25 to 27, the limiter mandrel 510 can include a limiter nozzle 514 positioned in the limiter passage 512 and having a nozzle opening 516 therethrough. The limiter housing 502 can define a fluid chamber 518 having internal walls 520 spaced from the limiter mandrel 510. In addition, the limiter mandrel 510 can be provided with flow openings 522 adapted to establish fluid communication between the limiter passage 512 and the fluid chamber 518. In the unrestricted configuration, the limiter nozzle 514 is positioned generally in the center of the fluid chamber 518, with flow openings 522 provided upstream and downstream of the limiter nozzle 514. Therefore, it is noted that fluid flowing through the flow limiter 500 will take the path of least resistance and flow around the flow nozzle 514 via the flow openings 522 (as illustrated by the arrows in FIG. 26).

When in the restricted configuration, the limiter housing 502 is adapted to block the flow openings provided downstream of the flow nozzle 514 such that fluid flow is restricted to flowing through the nozzle opening 516 of the limiter nozzle 514 (as illustrated by the arrows in FIG. 27). As seen in FIG. 27, when in the restricted configuration, the limiter nozzle 514 is positioned within the limiter housing 502, thereby occluding some of the flow openings 522 and preventing fluid from flowing around the limiter nozzle 514. In this implementation, operating the flow limiter from the unrestricted to the restricted configuration includes displacing the limiter housing 502 uphole such that the flow openings 522 downstream of the flow nozzle 514 are occluded by the limiter housing 502 adjacent the fluid chamber 518. The contact between the flow nozzle 514 and the limiter housing 502 can define a seal, such as a non-elastomeric seal (e.g., metal-to-metal seal). Alternatively, one of the flow nozzle 514 and the limiter housing 502 can be provided with an elastomer/polymer type seal to define the seal, for example.

The housing 502 can be displaced via operation of the actuator 200 at the setting fluid pressure. As previously described, when the hydraulic pressure reaches the setting fluid pressure, the actuator exerts a force in the uphole direction to position the anchoring tool 100 in the mechanically set configuration. In this implementation, and with reference to FIG. 22, with the flow limiter 500 coupled between the anchoring tool 100 and the actuator 200, the actuator 200 is adapted to shift both the limiter housing and the housing of the anchoring tool uphole. It is thus noted that the anchoring tool 100 is operated in the mechanically set configuration and that the flow limiter 500 is operated in the restricted configuration substantially simultaneously and via the same motion of the actuator 200. For example, in a particular application, the tubing string can have an outer diameter of about 2⅜ inches, a length of about 7500 m, with a wall thickness of about 0.200 inches. Fluid can be pumped down this particular tubing at a flowrate of about 800 liters per minute (lpm) when the flow limiter is operated in the unrestricted configuration. As the pressure increases and the actuator expands, the flow limiter shifts into the flow restricting configuration, thereby restricting the flowrate to about 300 lpm through the nozzle opening 516. It is appreciated that other configurations, sizes, and features of the tubing string and flow limiter are possible and may be used.

In the above-described implementations, the shifting tool 300 can be provided with a locator 310 adapted to cooperate with the downhole component (e.g., the valve assembly 400) for identifying the location of the stroker tool 25 along to the wellbore. The locator 310 can be complementarily shaped relative to a profile defined along the wellbore, such as in the casing (e.g., in a blank sleeve), within the valve assembly or at any other location. Therefore, the stroker tool 25 can be run downhole until the locator 310 engages the profile which at least partially prevents further downhole movement of the stroker tool 25 along the wellbore. It should be noted that the location of the profile down the wellbore is typically known such that the location of the stroker tool 25 can be determined once the locator 310 engages the profile.

Figure 22:
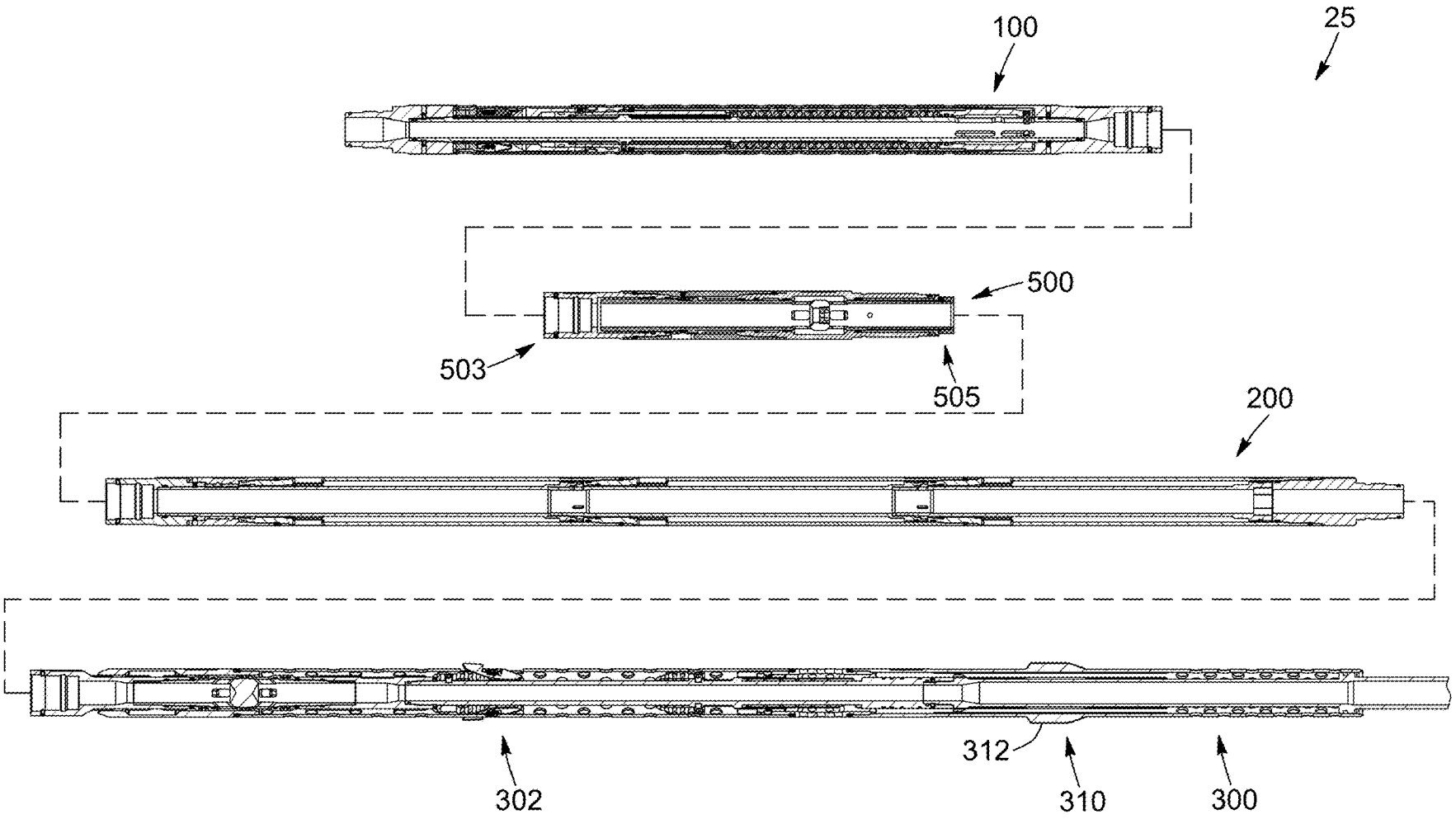
FIG. 22 is a cross-sectional view of an alternate implementation of the bottomhole assembly, showing the hydraulic anchor, a flow limiter, an actuator and a shifting tool connectable to one another.
Figure 23:
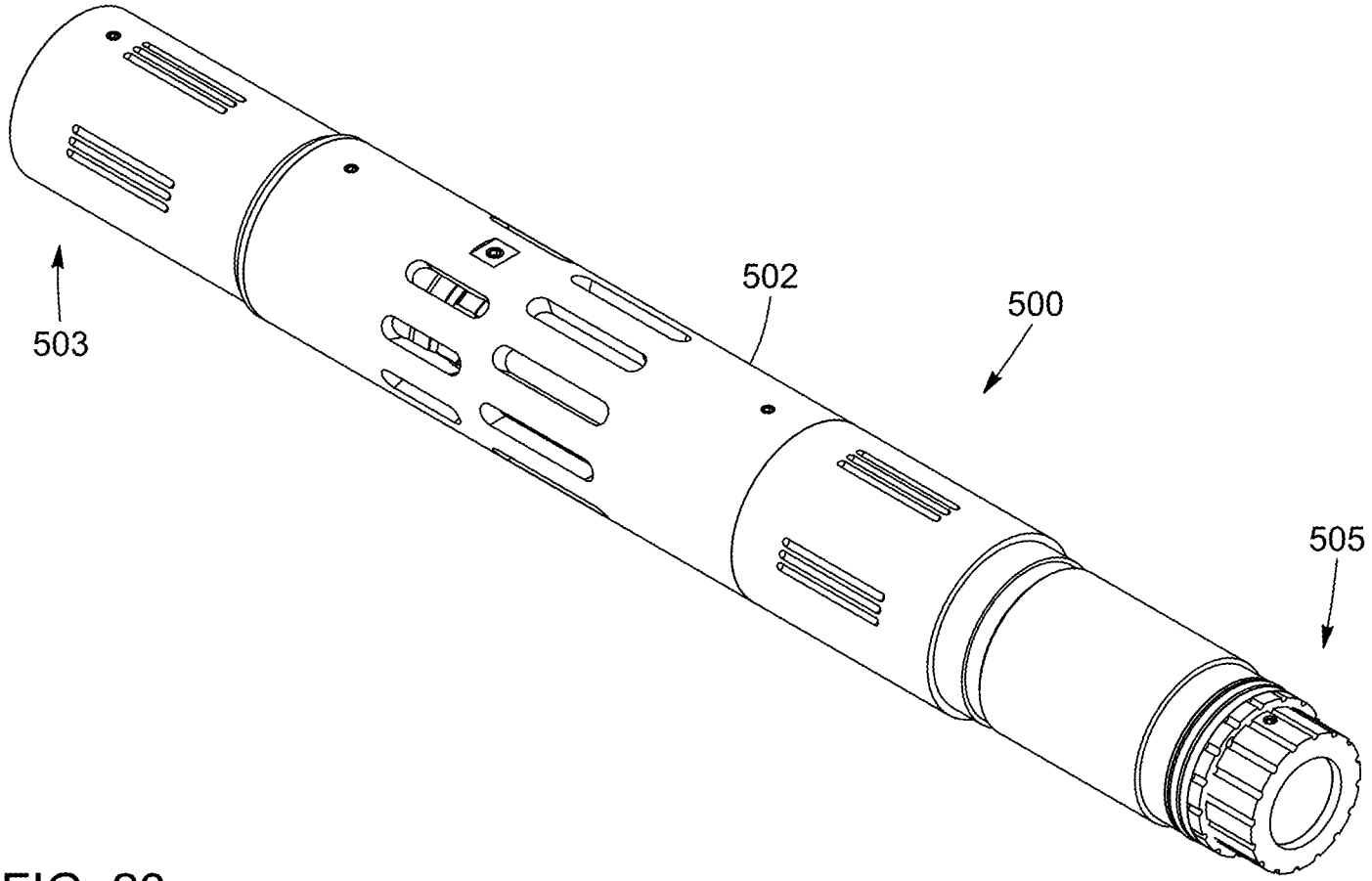
FIG. 23 is a perspective view of the flow limiter shown in FIG. 22, according to a possible implementation.
Figure 24:
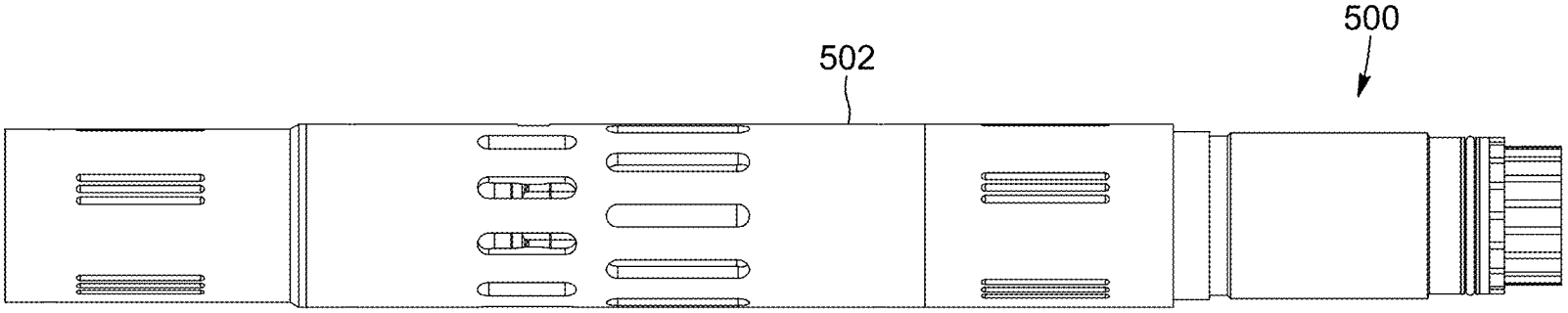
FIG. 24 is a side view of the flow limiter shown in FIG. 23, with FIG. 25 being a cross-sectional view of the flow limiter of FIG. 24, showing a limiter nozzle positioned within a flow limiter passage, according to possible implementations.

In this implementation, and with reference to FIGS. 17 and 22, the locator 310 includes one or more collet 312 extending outwardly from the housing of the shifting tool 300. As mentioned, the collet 312 can be complementarily shaped relative to the profile, and are thus adapted to engage the profile as the stroker tool 25 is run downhole. In some implementations, the locator 310 can include a plurality of collet segments, or "fins", such as two, three, four or any other suitable number of collet segments. The fins can be spaced from one another and provided at regular intervals about the shifting tool 300, although other configurations are possible. In this implementation, the profile is defined in the valve assembly to enable the shifting tool 300 to be aligned with the valve assembly when the locator 310 locates the profile. More specifically, the locator 310 can be designed such that when the collet 312 engage the profile within the valve assembly, the gripping portion 302 (also referred to as a mechanical anchor) is aligned with the valve sleeve and can be secured thereto.

As seen in FIGS. 17 and 22, the locator 310 is spaced from the gripping portion 302, and can more specifically be provided downhole of the gripping portion 302. It is thus noted that the profile can be defined downhole of the valve sleeve along the valve assembly housing (e.g., a recessed portion of the valve assembly housing) to enable alignment and/or engagement of the locator collet 312 with the profile, and alignment of the gripping portion 302 with the valve sleeve for engagement therewith. The actuator can then be operated to expand and push the shifting tool 300 downhole, thereby dragging the valve sleeve downhole into the open position. In some implementations, the collet 312 can be inwardly compressed, e.g., toward the shifting tool housing, to disengage the profile and enable substantially unhindered movement of the stroker tool 25 along the wellbore (e.g., for pulling the tool to surface, or further downhole, such as toward another valve assembly). It is noted that the valve sleeve can be adapted to slide into the profile thereby engaging and inwardly compressing the collet 312. In other words, once the valve sleeve is opened, the locator 310 at least partially disengages the profile to enable subsequent movement of the stroker tool 25.

It should be appreciated from the present disclosure that the various implementations of the bottomhole assembly, stroker tool and related components enable the stroker tool to be positioned at a desired location along the wellbore prior to being connected to a downhole component, such as a valve assembly via the shifting tool. The anchoring tool, or hydraulic anchor, can be hydraulically operated to create a mechanical brace for the actuator to brace up against. The actuator is similarly hydraulically operated to generate a downhole mechanical force, such as via a linear extension of a portion of the actuator. The mechanical force urges the shifting tool downhole, which shifts the valve assembly in the open configuration. Moreover, the integration of a flow limiter in the stroker tool regulates the ingress of fluid in the actuator in order to limit the speed at which the actuator expands along the wellbore and urges the shifting tool downhole. The present stroker tool facilitates the life of well management by enabling opening and/or closing specific sleeves without shifting other sleeves. The stroker tool can also be used to shift stuck sleeves which require great mechanical force to become unstuck. The stroker tool also does not require to define a closed system uphole of the tool to generate the required pressure along the annulus defined between the tubing string and the casing of the wellbore. Instead, the stroker tool uses hydraulic force to create a mechanical brace, and further uses hydraulic force and converts it into a mechanical force to enable shifting sleeves.

As described above, the stroker tool is operable for opening valves disposed along the wellbore and establish fluid communication between the surface and the reservoir. Therefore, the stroker tool can be used as part of various operations, such as in a hydrocarbon-containing reservoir for injecting or producing fluids through the valve. In some implementations, the reservoir is fractured as part of a plug-and-perf operation, and fluid is injected into the reservoir as part of a waterflooding operation, CO2 flooding operation, or any other suitable injection operations. The valve assemblies can be operated to enable production of fluids as part of geothermal operations or acid solution mining operations, among other possible operational configurations of the wellbore.

The bottomhole assembly can also be used as for various other downhole operations (i.e., different operations than shifting the valve sleeve of the valve assembly). In such implementations, it is noted that the shifting can be removed, replaced and/or provided with additional components for performing different downhole operations.

The present disclosure may be embodied in other specific forms without departing from the subject matter of the claims. The described example implementations are to be considered in all respects as being only illustrative and not restrictive. For example, in the implementations described herein, the hydraulic anchor is configured to be secured to the casing of the wellbore, with the shifting tool being connected to the valve sleeve for shifting the valve sleeve open. In alternate implementations, the hydraulic anchor can be positioned within the valve assembly such that the anchor assembly can be configured to be secured to the valve sleeve. In such implementations, it is noted that the shifting tool can be connected to the casing of the wellbore, or alternatively to another valve sleeve. The actuator is operated to expand between the hydraulic anchor and the shifting tool, thereby generating a force on the one or more valve sleeves until the shear connectors break, for example. It is appreciated that the stroker tool can be used to open valve sleeves which shift open in either the uphole direction and/or the downhole direction.

It should also be noted that the stroker tool can be used to operate the valve assembly from the open configuration to the closed configuration (e.g., by closing the valve sleeve). For example, the anchoring tool can be positioned within the valve assembly to secure the anchors to the valve sleeve, and the shifting tool can be secured to the casing of the wellbore, for example, downhole of the valve assembly. Once both the anchoring tool and the shifting tool are secured, the actuator is actuated and expands between the anchoring tool and shifting tool, thus generating a pushing force on the mechanical brace which urges the valve sleeve into the closed position. In some implementations, the valve sleeve is urged in the uphole direction in order to move to the closed position. As such, it is appreciated that the shifting tool is secured to the casing downhole of the valve assembly. However, it should be noted that other configurations are possible, such as moving the valve sleeve in the downhole direction in order to close the valve assembly, for example.

In order to locate open sleeves along the wellbore, the valve assemblies can be provided with a profile shaped and adapted to cooperate with the locator of the shifting tool. For example, after shifting a valve sleeve into the open position, a second profile can be defined in the space where the valve sleeve used to be (i.e., when in the closed position). Therefore, the shifting tool can be positioned within the valve assembly by having the locator engage the second profile. The stroker tool can then be run further downhole in order to position the anchoring tool in the valve assembly for engagement therewith, and for closing the valve sleeve. It is noted that the overall length of the stroker tool, along with the lengths of each one of its components, are known. As such, after the locator of the shifting tool engages the second profile, an operator can know the distance between the locator and the anchor assembly such that the stroker tool is run further downhole by substantially said distance, thereby positioning the anchors in alignment with the valve sleeve. The anchors can then be secured to the valve sleeve, and the shifting tool can be secured to the casing of the wellbore. Then, the actuator can be operated and expands, thereby pushing the bottom sub uphole to define the mechanical brace, and generating a pushing force on the mechanical brace which urges the valve sleeve into the closed position.

It should also be noted that the stroker tool can be installed in other configurations, such as with the shifting tool being uphole of the actuator, which is in turn uphole of the hydraulic anchor. In such implementations, it is appreciated that the mechanical force required to shift the valve sleeve would be generated in the uphole direction. In yet another possible implementation, the shifting tool can be replaced by another hydraulic anchor such that the stroker tool includes a pair of hydraulic anchors at either ends, with the actuator in between the hydraulic anchors.

In some implementations, it is appreciated that the actuator can be "flipped upside down", with the outer portion being coupled to the hydraulic anchor, and the inner portion being coupled to the shifting tool, for example. During expansion, the outer portion will be adapted to push against the mechanical brace, and the inner portion will be adapted to push against the shifting tool to generate the force required to shift the valve sleeve open. In addition, throughout the disclosure, the mechanical force is generated in the downhole direction toward the shifting tool in order to shift the valve sleeve open (i.e., also in the downhole direction). However, it is appreciated that, depending on the orientation and/or configuration of the stroker tool, the mechanical force required to shift the valve sleeve can be generated in the uphole direction, or a combination of the downhole and uphole directions.

The present disclosure intends to cover and embrace all suitable changes in technology. The scope of the present disclosure is, therefore, described by the appended claims rather than by the foregoing description. The scope of the claims should not be limited by the implementations set forth in the examples, but should be given the broadest interpretation consistent with the description as a whole.

As used herein, the terms "coupled", "coupling", "attached", "connected" or variants thereof as used herein can have several different meanings depending in the context in which these terms are used. For example, the terms coupled, coupling, connected or attached can have a mechanical connotation. For example, as used herein, the terms coupled, coupling or attached can indicate that two elements or devices are directly connected to one another or connected to one another through one or more intermediate elements or devices via a mechanical element depending on the particular context.

In the above description, the same numerical references refer to similar elements. Furthermore, for the sake of simplicity and clarity, namely so as to not unduly burden the figures with several references numbers, not all figures contain references to all the components and features, and references to some components and features may be found in only one figure, and components and features of the present disclosure which are illustrated in other figures can be easily inferred therefrom. The implementations, geometrical configurations, materials mentioned and/or dimensions shown in the figures are optional, and are given for exemplification purposes only.

In addition, although the optional configurations as illustrated in the accompanying drawings comprises various components and although the optional configurations of the valve assembly as shown may consist of certain geometrical configurations as explained and illustrated herein, not all of these components and geometries are essential and thus should not be taken in their restrictive sense, i.e. should not be taken as to limit the scope of the present disclosure. It is to be understood that other suitable components and cooperations thereinbetween, as well as other suitable geometrical configurations may be used for the implementation and use of the valve assembly, and corresponding parts, as briefly explained and as can be easily inferred herefrom, without departing from the scope of the disclosure.

What is claimed is:

1. A bottomhole assembly for use in actuating a valve assembly disposed along a wellbore defined within a subterranean reservoir, comprising:

an anchoring tool comprising:

a tubular housing comprising a top sub, a bottom sub and an outer wall extending between the top and bottom subs, the outer wall being provided with one or more openings;

a central mandrel secured between the top and bottom subs and positioned within the outer wall to define an annular region therebetween, the central mandrel defining a fluid passage therethrough and is adapted to establish fluid communication between the top and bottom subs;

an anchor assembly, comprising:

an anchor carrier slidably mounted within the annular region; and an anchor pivotally connected to the anchor carrier and being operable between a disconnected position where the anchor is at least partially within the annular region, and a connected position after pivoting outwardly through the opening of the outer wall to engage internal surfaces of a wellbore casing and secure the anchor assembly relative to the wellbore; and a piston assembly, comprising:

a piston body slidably mounted within the annular region, the piston body defining a piston chamber in fluid communication with the fluid passage, the piston body being actuatable via fluid pressure to slide uphole within the annular region; and a piston head coupled to the piston body and being adapted to slide in an uphole direction upon actuation of the piston body to engage and operate the anchor from the disconnected position in the connected position, the anchoring tool being operable between an unset configuration in which the anchor is in the disconnected position, a pre-set configuration in which the anchor is in the connected position, and a set configuration in which the anchor is in the connected position and the bottom sub abuts the piston body such that the anchor assembly, the piston assembly and the housing define a mechanical brace for transmission of a downhole mechanical force to the valve assembly.

2. The bottomhole assembly according to claim 1, wherein a downhole chamber is defined when the piston assembly is actuated uphole to engage the piston head with the anchor, the downhole chamber being in fluid communication with the fluid passage.

3. The bottomhole assembly according to claim 2, wherein the bottom sub is displaced into the downhole chamber to abut the piston body and define the mechanical brace.

4. The bottomhole assembly according to claim 1, wherein the piston assembly is operable at an anchoring fluid pressure adapted to displace the piston body and piston head in the uphole direction to engage the anchor.

5. The bottomhole assembly according to claim 1, wherein the piston body comprises at least one guiding stud, and wherein the central mandrel comprises at least one guiding channel, the guiding stud being adapted to engage the guiding channel to block rotational movement of the piston assembly about the central mandrel and axially guide the piston assembly along the central mandrel.

6. The bottomhole assembly according to claim 1, further comprising a shifting tool connectable to the valve assembly, and an actuator operatively coupled between the anchoring tool and the shifting tool, the actuator being adapted to cooperate with the mechanical brace to increase the downhole mechanical force to actuate the shifting tool to shift the valve assembly between various configurations.

7. The bottomhole assembly according to claim 6, wherein the actuator is a linear actuator and comprises an inner portion coupled to the anchoring tool and adapted to cooperate with the mechanical brace, and an outer portion slidably mounted to the inner portion, wherein the actuator is operable to displace the outer portion to apply the downhole mechanical force on the shifting tool.

8. The bottomhole assembly according to claim 7, wherein the inner portion comprises an actuator sub coupled to the anchoring tool, and an actuator mandrel connected to and extending from the actuator sub, and wherein the outer portion comprises an actuator housing slidably mounted to the actuator mandrel and defining an actuator annular region therebetween.

9. The bottomhole assembly according to claim 8, wherein the actuator comprises an actuator piston assembly provided in the actuator annular region and in fluid communication with the fluid passage, the actuator piston assembly being operable via fluid pressure at a shifting fluid pressure to displace the outer portion downhole.

10. The bottomhole assembly according to claim 9, wherein the shifting fluid pressure is between about 6,000 psi and 10,000 psi, and wherein the anchoring fluid pressure is less than the shifting fluid pressure.

11. The bottomhole assembly according to claim 9, wherein the actuator piston assembly is operable at a setting fluid pressure provided between the anchoring fluid pressure and the shifting fluid pressure and being adapted to apply hydraulic pressure on the housing of the anchoring tool to push the bottom sub against the piston body, thereby operating the anchoring tool from the pre-set configuration to the set configuration.

12. The bottomhole assembly according to claim 1, further comprising a flow limiter coupled between and in fluid communication with the anchoring tool and the actuator, the flow limiter being operable between an unrestricted configuration where fluid flowrate remains substantially the same through the flow limiter, and a flow-restricting configuration where fluid flowrate is reduced through the flow limiter.

13. The bottomhole assembly according to claim 12, wherein the flow limiter is hydraulically operable between the unrestricted and the flow-restricting configurations.

14. The bottomhole assembly according to claim 12, wherein the flow limiter comprises a limiter housing and a limiter mandrel extending through the limiter housing, and wherein the limiter housing is slidably mounted to the limiter mandrel.

15. The bottomhole assembly according to claim 14, wherein:

the limiter housing defines a fluid chamber having inner walls spaced from the limiter mandrel, the flow limiter further comprises a limiter nozzle positioned along the limiter mandrel within the fluid chamber, the limiter nozzle being provided with a nozzle opening adapted to restrict fluid flow therethrough, the limiter mandrel comprises fluid channels extending through a thickness of the limiter mandrel for establishing fluid communication between the limiter mandrel and the fluid chamber, and the fluid channels comprise upstream fluid channels provided upstream of the limiter nozzle and downstream fluid channels provided downstream of the limiter nozzle.

16. The bottomhole assembly according to claim 15, wherein:

when in the unrestricted configuration, each one of the fluid channels is in fluid communication with the fluid chamber such that fluid flowing through the limiter mandrel is adapted to flow around the limiter nozzle via the fluid channels and fluid chamber, and when in the flow-restricting configuration, the limiter housing is adapted to slide relative to the limiter nozzle to occlude one of the downstream and upstream fluid channels, thereby restricting fluid flow through the nozzle opening of the limiter nozzle.

17. A method of shifting a valve sleeve of a valve assembly provided along a wellbore string disposed within a wellbore defined within a subterranean reservoir using a stroker tool, comprising:

injecting fluid down the wellbore string to increase a fluid pressure within a hydraulic anchor of the stroker tool to an anchoring pressure adapted to have a piston assembly of the hydraulic anchor engage and secure an anchor assembly of the hydraulic anchor to a wellbore casing;

increasing the fluid pressure to a setting pressure adapted to engage a housing of the hydraulic anchor with the piston assembly to set the hydraulic anchor, with the housing, the piston assembly and the anchor assembly defining a mechanical brace with the wellbore; and increasing the fluid pressure to a shifting pressure adapted to operate an actuator of a bottomhole assembly, the actuator being adapted to brace on the mechanical brace for creating a downhole mechanical force for actuating a shifting tool connected to the valve sleeve.

18. The method of claim 17, wherein the valve sleeve is secured along the wellbore via shear connectors, and wherein the downhole mechanical force is adapted to break the shear connectors.

19. A high force stroker tool for integration within a wellbore string disposed along a wellbore defined within a subterranean reservoir, comprising:

a hydraulic anchor hydraulically operable to deploy slips securable to the wellbore and to define a mechanical brace;

a shifting tool operatively coupled to the hydraulic anchor and comprising a mechanical anchor securable to a movable component, the shifting tool being mechanically operable to move the movable component; and an actuator coupled between the hydraulic anchor and the shifting tool, the actuator being hydraulically operable to brace against the mechanical brace and create a downhole mechanical force adapted to mechanically operate the shifting tool.

20. The high force stroker tool of claim 19, further comprising a pressure switch operable to restrict a flowrate of fluid into the actuator.

* * * * *